US006169560B1

(12) United States Patent
Yoshida et al.

(10) Patent No.: US 6,169,560 B1
(45) **Date of Patent: *Jan. 2, 2001**

(54) THERMAL TRANSFER RECORDING APPARATUS WITH INK SHEET SLACKNESS REMOVAL

(75) Inventors: Takehiro Yoshida, Tokyo; Makoto Kobayashi, Tama; Minoru Yokoyama, Yokohama; Takeshi Ono, Kawasaki; Takashi Awai; Yasushi Ishida, both of Tokyo; Akihiro Tomoda; Tomoyuki Takeda, both of Yokohama; Masaya Kondo, Tokyo; Masakatsu Yamada, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/977,389

(22) Filed: Nov. 24, 1997

Related U.S. Application Data

(63) Continuation of application No. 08/347,163, filed on Nov. 23, 1994, now abandoned, which is a continuation of application No. 07/812,948, filed on Dec. 24, 1991, now abandoned.

(30) Foreign Application Priority Data

| | | |
|---|---|---|
| Dec. 25, 1990 | (JP) | 2-405892 |
| Jan. 16, 1991 | (JP) | 3-003397 |
| Sep. 30, 1991 | (JP) | 3-251169 |

(51) Int. Cl.[7] ..... B41J 35/08
(52) U.S. Cl. ..... 347/217
(58) Field of Search ..... 347/214, 215, 347/217, 219; 400/208, 234, 236, 690.4

(56) References Cited

U.S. PATENT DOCUMENTS

| | | | | |
|---|---|---|---|---|
| 3,984,809 | | 10/1976 | Dartouzos et al. | 317/206 |
| 4,527,172 | * | 7/1985 | Nagashima et al. | 347/214 |
| 4,614,949 | * | 9/1986 | Hakkaku et al. | 347/215 |
| 4,712,113 | * | 12/1987 | Brooks et al. | 347/217 |
| 4,771,296 | * | 9/1988 | Shimada et al. | 347/217 |
| 4,788,588 | * | 11/1988 | Caldwell et al. | 347/215 |
| 4,878,773 | * | 11/1989 | Mazunder | 400/234 |
| 5,117,241 | * | 5/1992 | Stephenson | 400/234 |
| 5,384,584 | * | 1/1995 | Yoshida et al. | 347/215 |
| 5,497,183 | | 3/1996 | Yoshida et al. | 347/215 |
| 5,786,842 | * | 7/1998 | Awai et al. | 347/217 |

FOREIGN PATENT DOCUMENTS

| | | | | |
|---|---|---|---|---|
| 58-7377 | | 1/1983 | (JP) . | |
| 201686 | * | 11/1983 | (JP) . | |
| 0024490 | * | 2/1986 | (JP) | 400/234 |
| 202777 | * | 9/1987 | (JP) | 400/234 |
| 221076 | * | 9/1988 | (JP) | 400/690.4 |
| 2-121866 | | 5/1990 | (JP) . | |

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

There is disclosed a recording apparatus for recording an image by transferring the ink contained in an ink sheet onto a recording medium, wherein the apparatus comprises ink sheet driving unit for driving said ink sheet, recording medium conveying unit for conveying said recording medium, recording head for recording onto said recording medium by acting on said ink sheet, slackness removing device for removing the slackness of said ink sheet, and control unit for controlling said slackness removing device so as not to remove the slackness of said ink sheet, when it is impossible to record with said recording head.

12 Claims, 32 Drawing Sheets

| |
|---|
| FIG. 6A |
| FIG. 6B |

FIG. 21A
FIG. 21
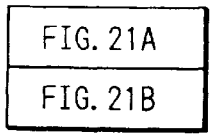
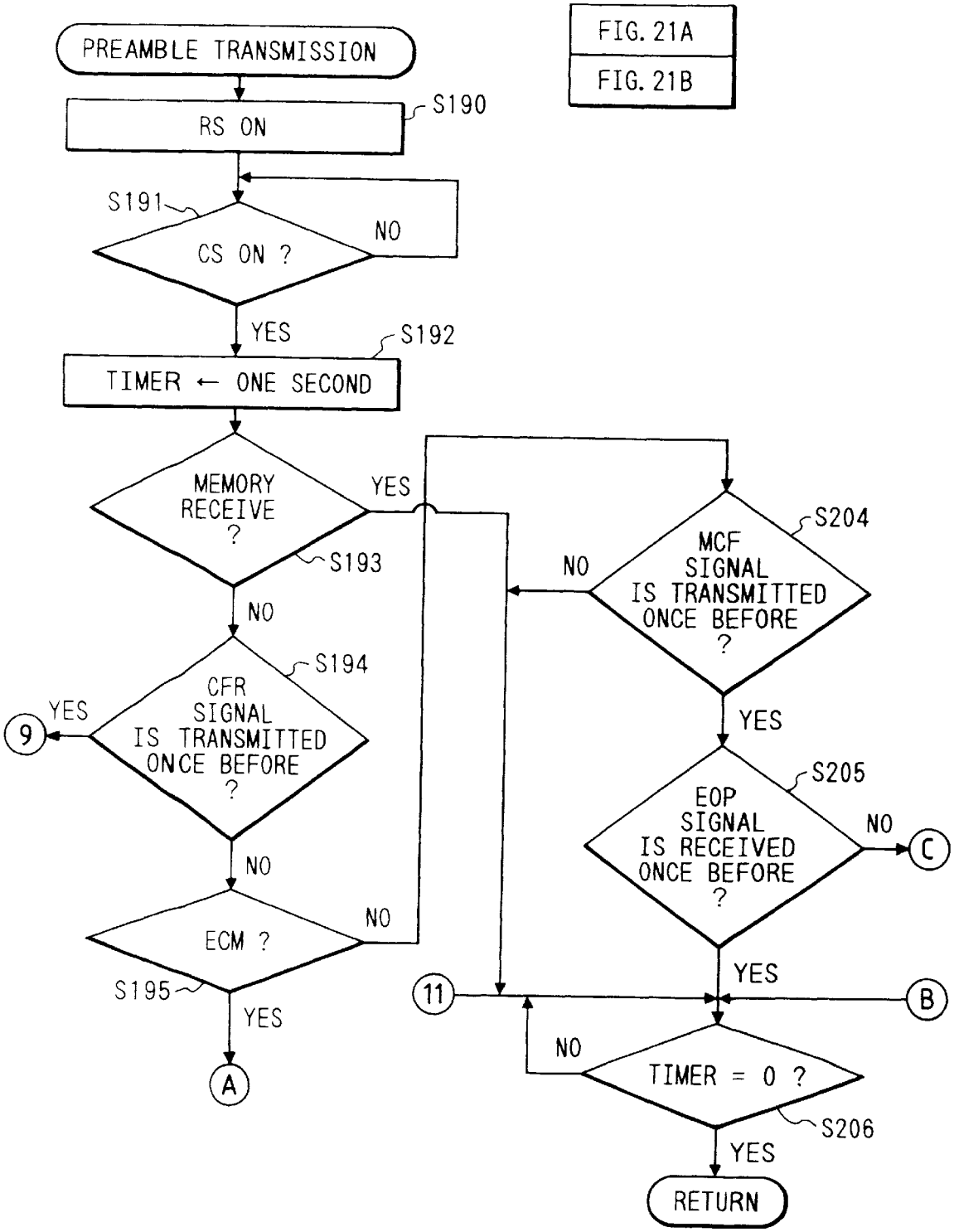

8
RECEIVE AT CONSTANT SPEED ?
YES
S207
9
NO
11
S208
NO
INKF = 0 ?
YES
S209
F. INKNG = 0 ?
YES
NO
S211
START PIC MOTOR
S210
NVALSE ← 1
TIMER ← A PREDETERMINED TIME
S212
11
NSTS ← STATUS OF PRESENT SENSOR 19
S213
S214
YES
MOTOR 25 IS BUSY ?
NO
ROTATE MOTOR 25 BY EIGHT HALF STEPS
S215
S216
NSTS = STATUS OF INPUTTED SENSOR 19 ?
NO
S217
NVALSE ← 1
YES
NO
TIMER = 0 ?
STOP PIC MOTOR
S224
S218
YES
NVALSE ← 0
S225
10
STOP PIC MOTOR
S226
RETURN

THERMAL TRANSFER RECORDING APPARATUS WITH INK SHEET SLACKNESS REMOVAL

This application is a continuation of application Ser. No. 08/347,163 filed Nov. 23, 1994, now abandoned which is a continuation of application Ser. No. 07/812,948 filed Dec. 24, 1991, now abandoned.

BACKGROUND OF THE INVENTION

1. Field of the Invention

The present invention relates to a thermal transfer recording apparatus for recording an image onto a recording medium by transferring the ink contained in an ink sheet to the recording medium, and more particularly to a thermal transfer recording apparatus wherein the length of ink sheet to be used for the recording is L/n (n>1) for a predetermined recording length L.

2. Related Background Art

Generally, a thermal transfer recording apparatus uses an ink sheet with the heat-fusible ink applied to the base film to heat selectively the ink sheet with a thermal head in accordance with an image signal, and record an image by transferring the fused ink onto a recording sheet. As this ink sheet in general allows the ink to be transferred entirely onto the recording sheet with one time of recording (one-time sheet), it is needed to convey the ink sheet by an amount corresponding to the recorded length and then to bring unused part of the ink sheet to the next recording position with accuracy, after one character or line has been recorded. Therefore, with increasing usage of the ink sheet, the running cost for the thermal transfer recording apparatus is greatly higher than for the thermal sensitizing recording apparatus.

To solve the above problem, a thermal transfer recording apparatus has been proposed in which a recording sheet and an ink sheet are conveyed with a difference of speed in recording, as described in U.S. Pat. No. 3,984,809, and or Japanese Laid-Open Patent Application No. 62-58917.

In the above-mentioned conventional example, the ink sheet and the recording sheet are rubbed against each other during the thermal transfer recording, because the use length of the ink sheet is L/n (n>1) for the conveyance length of the recording sheet L. Thus, there is a problem that if there is a slackness in the ink sheet in recording, the correct recording is not assured as the ink sheet and the recording sheet may be conveyed at the same speed. Further, as the ink sheet and the recording sheet may be adhered to each other, it is possible that the ink sheet is damaged or the recording sheet is stained.

In general, the ink sheet being extended between an ink sheet supply roll and an ink sheet take-up roll is pressed against the thermal head, and conveyed by rotating a shaft of the take-up roll. Such an ink sheet conveying mechanism has the advantage that the recording can be fairly made without causing wrinkles on the ink sheet, owing to its simple structure with the ability of conveying the ink sheet with substantially the same force across its width. On the contrary, there is not constant drawback that the travel amount of the ink sheet is not constant for a predetermined rotational amount of an ink sheet motor, because of varying diameter of the ink sheet take-up roll.

However, after the exchange of an ink sheet cartridge, the conveyance length of the ink sheet can not be made steady for that of the recording sheet unless the recording of one page has been terminated. That is, there is a fear that the image quality of recording for the first page after the exchange of the ink sheet cartridge can not be assured. Also, when the recording sheet is exchanged, the ink sheet within the ink sheet cartridge may be slackened, so that it may take some time to remove the slack from of the ink sheet in the first recording operation after the exchange of the recording sheet. Therefore, in the facsimile terminal equipment, when the first recording operation after the exchange of the recording sheet is the reception of facsimile signal, a transmission error may be caused if it takes some time to remove the slackness of the ink sheet.

On the other hand, there is a problem to be solved that if the slack of the ink sheet is unnecessarily made removed, some white streaks may arise on a recording image.

SUMMARY OF THE INVENTION

The present invention was achieved on the basis of the above-described related art with a new view which has not been conventionally foreseen.

It is an object of the present invention to provide a thermal transfer recording apparatus which overcomes the above-mentioned technical problems associated with the related art, and improves the recording quality in such a way as to allow the proper separation between an ink sheet and a recording medium by removing the slack of the ink sheet prior to the start of recording for the page, while not removing the slack of ink sheet if it is unnecessary.

It is another object of the present invention to provide a thermal transfer recording apparatus wherein the conveyance length of the ink sheet is almost constant for that of the recording sheet, in recording, from the first page, after the power is turned on, after the ink sheet cartridge is exchanged or after the recording sheet is exchanged.

It is another object of the present invention to provide a thermal transfer recording apparatus for recording an image by transferring the ink contained in an ink sheet onto a recording medium, comprising,

- ink sheet conveying means for conveying the ink sheet,
- recording medium conveying means for conveying the recording medium,
- recording means for recording onto the recording medium by acting on the ink sheet,
- slackness removing means for removing the slackness of the ink sheet, and
- control means for controlling the slackness removing means so as not to remove the slackness of the ink sheet, when it is impossible to record with the recording means.

Here, the control means can also control the slackness removing means so as not to remove the slackness of the ink sheet, when a reception acknowledge signal for a signal which is not associated with the physical page breakpoint is transmitted or the memory is received.

It is another object of the present invention to provide a thermal transfer recording apparatus for recording an image by transferring the ink contained in an ink sheet onto a recording medium, comprising,

- ink sheet conveying means for conveying the ink sheet,
- recording medium conveying means for conveying the recording medium,
- recording means for recording onto the recording medium by acting on the ink sheet,
- slackness removing means for removing the slackness of the ink sheet, opening/closing detecting means for detecting the opening or closing of a cover for the apparatus, and control means for controlling the slackness removing means so as not to remove the slackness of the ink sheet, when the opening/closing detecting means detects that the cover is turned from an open state to a closed state.

It is another object of the present invention to provide a thermal transfer recording apparatus for recording an image by transferring the ink contained in an ink sheet onto a recording medium, comprising, ink sheet conveying means for conveying the ink sheet, recording medium conveying means for conveying the recording medium, recording means for recording onto the recording medium by acting on the ink sheet, slackness removing means for removing the slackness of the ink sheet, detecting means for detecting the presence or absence of an ink sheet cartridge, and control means for controlling the slackness removing means to remove the slackness of the ink sheet, when the detecting means detects that the ink sheet cartridge has been exchanged.

It is another object of the present invention to provide a thermal transfer recording apparatus for recording an image by transferring the ink contained in an ink sheet onto a recording medium, comprising, ink sheet conveying means for conveying the ink sheet, recording medium conveying means for conveying the recording medium, recording means for recording onto the recording medium by acting on the ink sheet, slackness removing means for removing the slackness of the ink sheet, and control means for controlling the slackness removing means to remove the slackness of the ink sheet, when the power is detected to be turned on.

Here, the control means can control the slackness removing means to remove the slackness of the ink sheet, even during the procedure involved in the transmission or reception of the signal.

It is another object of the present invention to provide a facsimile apparatus for recording an image by transferring the ink contained in an ink sheet onto a recording medium, comprising ink sheet conveying means for conveying the ink sheet, recording medium conveying means for conveying the recording medium, image signal receiving means, recording means for recording onto the recording medium by acting on the ink sheet, based on an image signal received by the image signal receiving means, slackness removing means for removing the slackness of the ink sheet, and control means for controlling the slackness removing means to remove the slackness of the ink sheet, prior to the reception of the image signal.

It is another object of the present invention to provide a thermal transfer recording apparatus for recording an image by transferring the ink contained in an ink sheet onto a recording medium, comprising, ink sheet conveying means for conveying the ink sheet, recording medium conveying means for conveying the recording medium, recording means for recording onto the recording medium by acting on the ink sheet, slackness removing means for removing the slackness of the ink sheet, detecting means for detecting that the ink sheet has been conveyed by the ink sheet conveying means, and control means for determining that the ink sheet is disconnected, if the detecting means does not detect that the ink sheet has been conveyed, when the ink sheet conveying means is to be driven by a predetermined amount.

BRIEF DESCRIPTION OF DRAWINGS

FIGS. 21, 21A, 21B 22 and 23 are flowcharts showing a preamble transmission process.

DETAILED DESCRIPTION OF THE PREFERRED EMBODIMENTS

In the following, a preferred embodiment of this invention will be described in more detail with reference to the accompanying drawings.

An example 1 will be described in connection with an embodiment in which the slackness of the ink sheet is not removed, particularly when it is impossible to perform the recording with recording means, a reception acknowledge signal for a signal which is not associated with the physical page breakpoint is transmitted, or the memory is received.

EXAMPLE 1

Figure 1:
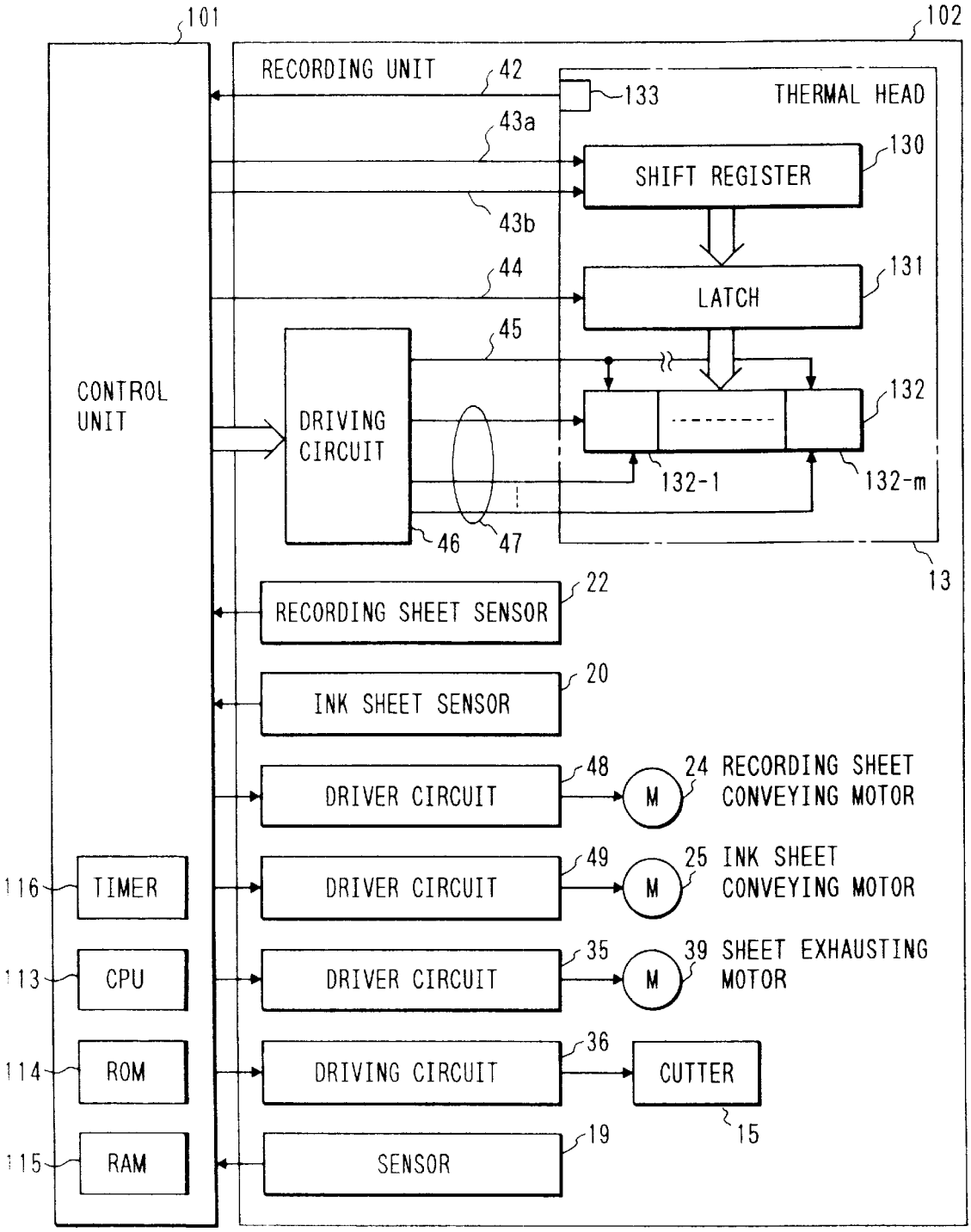
FIG. 1 is a block diagram showing the electrical connections between a control unit and a recording unit in a facsimile terminal equipment of an example 1.
Figure 2:
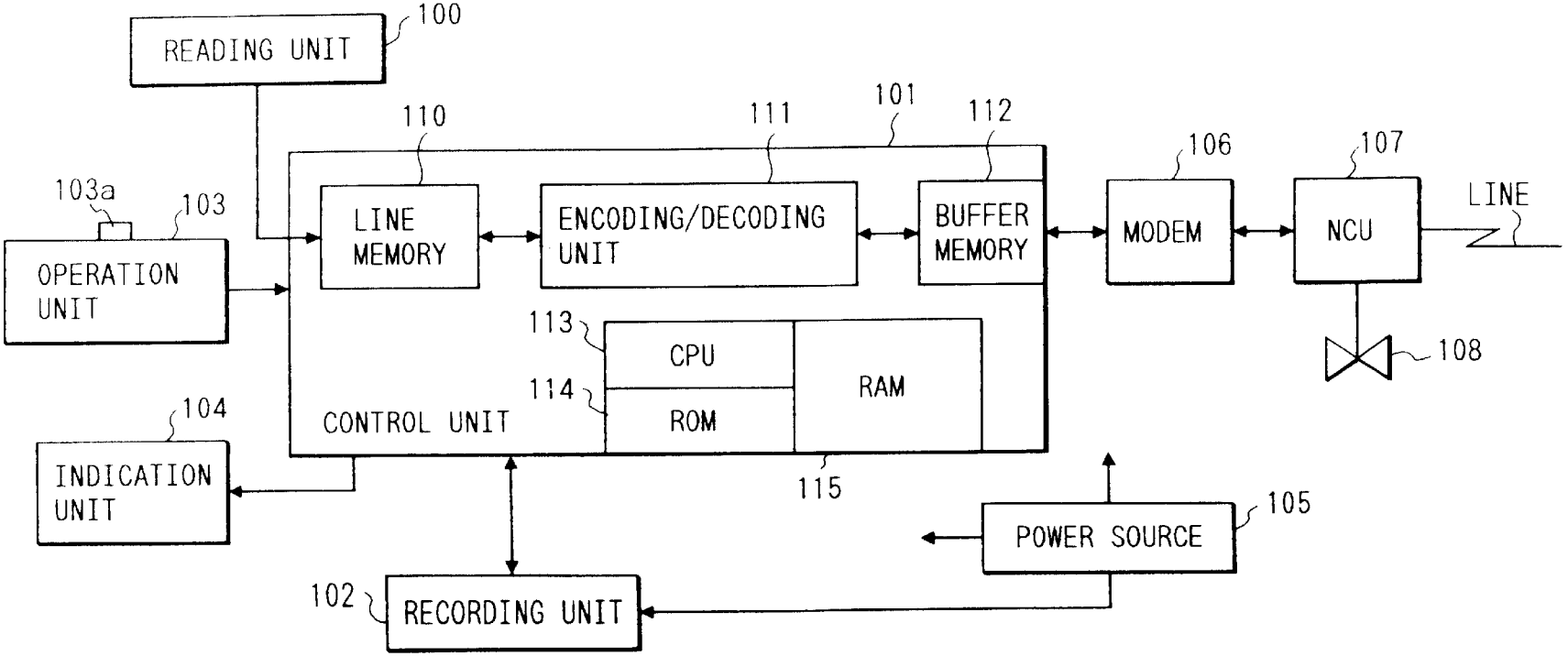
FIG. 2 is a block diagram showing a schematic configuration for the facsimile terminal equipment of the example 1.
Figure 3:
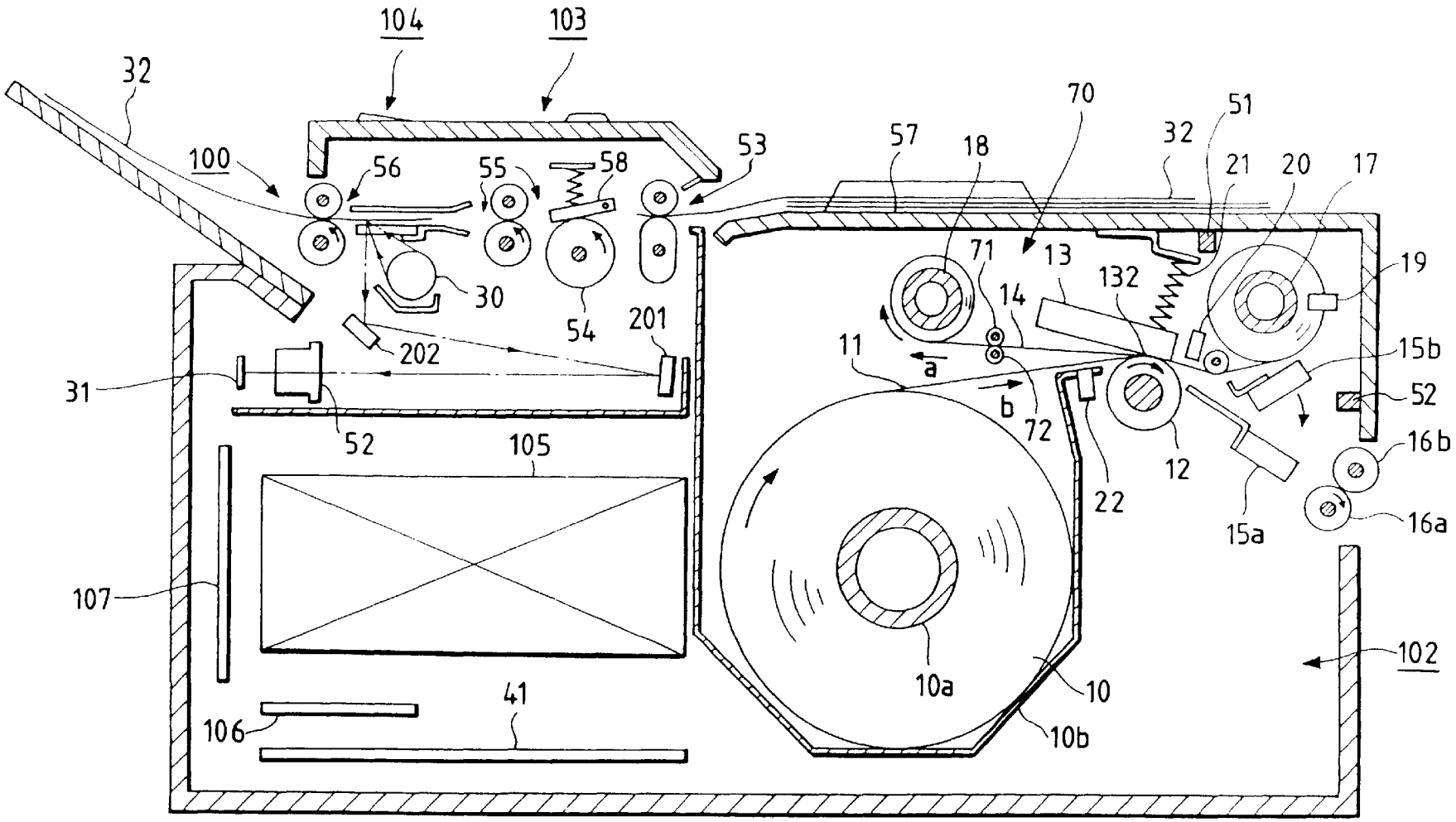
FIG. 3 is a side cross-sectional view showing the constitution of a mechanical unit in the facsimile terminal equipment of the example 1.
Figure 4:
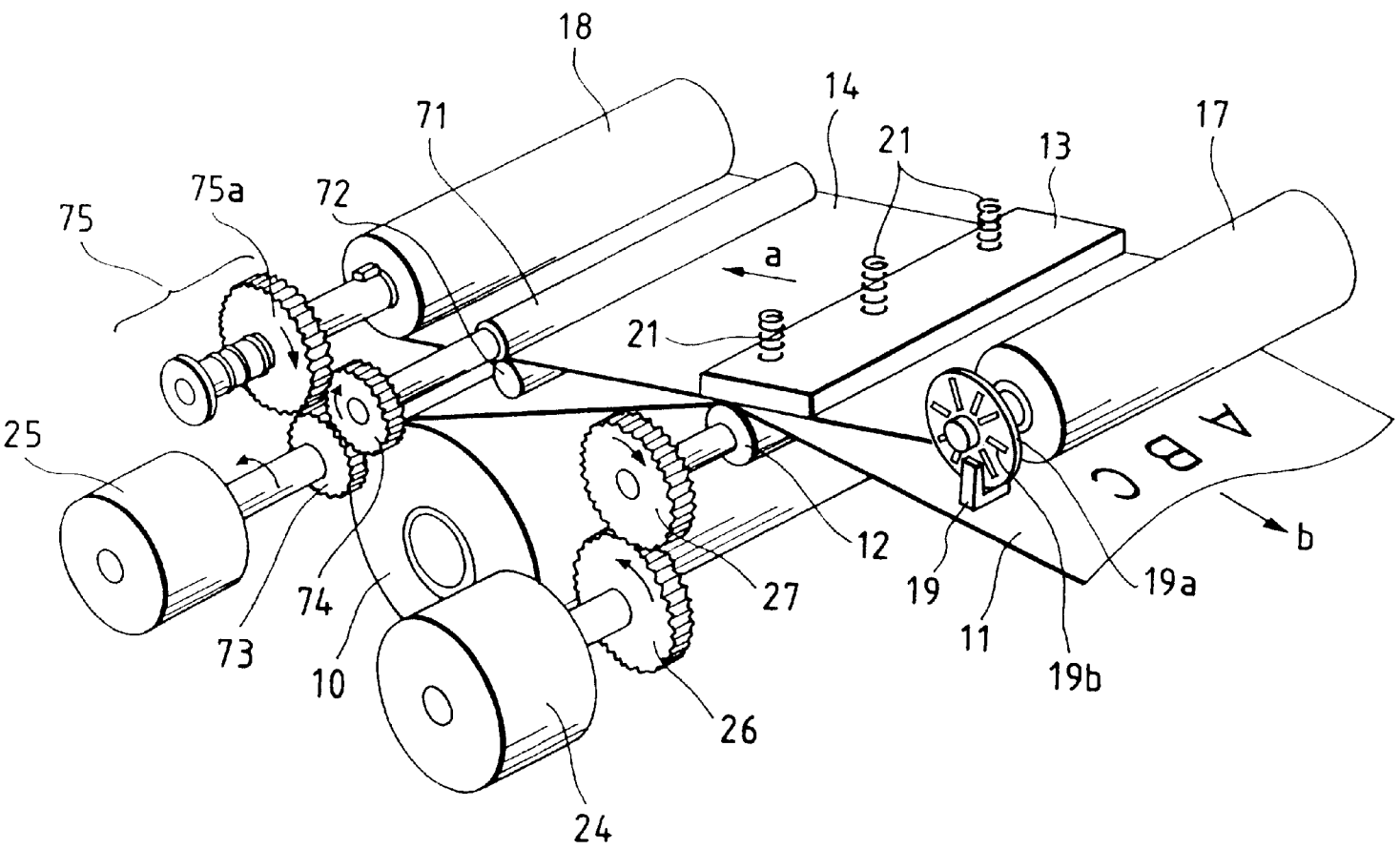
FIG. 4 is a view showing the structure of a conveying mechanism for the ink sheet and the recording sheet.

FIG. 1 is a view of the electrical connections between a recording control unit 101 and a recording unit 102, FIG. 2 is a block diagram showing a schematic configuration of a facsimile terminal equipment in the example, and FIG. 3 is a cross-sectional side view showing the facsimile terminal equipment, and FIG. 4 is a view showing a conveyance mechanism for the recording sheet and the ink sheet.

Referring now to FIG. 2, a schematic constitution of the facsimile terminal equipment in the example 1 will be described.

In FIG. 2, 100 is a reading unit for reading an original sheet photoelectrically and outputting it to a control unit 101 as a digital image signal, and is provided with a motor for conveying the original sheet and a CCD image sensor. Now the configuration of the control unit 101 will be described. 110 is a line memory for storing each line of image data, in which one line of image data from the reading unit 100 is stored for the transmission or copy of the original sheet, or one line of received and decoded image data is stored for the reception of image data. An image can be formed by the stored image data which is output to a recording unit 102. 111 is an encoding/decoding unit for encoding image data to be transmitted with a encoding method such as MH encoding, as well as decoding encoded image data that were received into image data. 112 is a buffer memory for storing encoded image data that will be transmitted or were received. Each of these portions in the control unit 101 is controlled by the CPU 113 such as a microprocessor. In addition to the CPU 113, the control unit 101 is provided with a ROM 114 for storing control programs for the CPU 113 or various data, and a RAM 115 for temporarily storing various flags or data as a work area for the CPU 113.

102 is a recording unit with a thermal line head for recording an image onto a recording sheet with a thermal transfer recording method. This constitution will be described later in more detail with reference to FIGS. 3 and 4. 103 is an operation unit which contains various keys for indicating functions such as the start of transmission, or the input keys for telephone number. 103*a* is a switch for indicating the type of ink sheet 14 to be used, i.e., indicating that a multi-print ink sheet is loaded if the switch 103*a* is on, and an ordinary ink sheet 14 is loaded if it is off. 104 is an indication unit, normally provided adjacent to the operation unit 103, for indicating various functions and statuses of the apparatus. 105 is a power source unit for supplying electric power to the entire apparatus. And 106 is a modem (modulator/demodulator), 107 is a network control unit (NCU), and 108 is a telephone.

Now referring to FIG. 3, the constitution of the recording unit 102 will be described below in more detail. Note that the common parts to FIG. 2 are indicated with the same numerals.

In the figure, 10 is a paper roll in which a recording sheet 11 which is plain paper is wound like a roll around a core 10*a*. The paper roll 10 is accommodated within the apparatus to be able to be freely rotated so that the recording sheet 11 may be supplied to a thermal head unit 13 with the rotation of a platen roller 12 in the arrow direction. Note that 10*b* is a paper roll loading section for detachably loading the paper roll. Further, 12 is a platen roller for conveying the recording sheet 11 in the direction as indicated by arrow b, as well as serving to press an ink sheet 14 and the recording sheet 11 against the heat generating elements 132 of thermal head 13. The recording sheet 11 having the image recorded by heating of the thermal head 13 is conveyed in the direction toward discharge rolled 16*a* and 16*b*, with a further rotation of the platen roller 12, and cut off for each page by a cutter 15 (15*a*, 15*b*) to be mated upon the termination of image recording for one page.

17 is an ink sheet supply roll having the ink sheet 14 wound thereon and 18 is an ink sheet take-up roll to be driven by an ink sheet conveying motor 25 as will be described later to wind the ink sheet 14 in the direction of arrow a. Note that the ink sheet supply roll 17 and the ink sheet take-up roll 18 are detachably loaded into an ink sheet loading section 70 within a main body of the apparatus. 19 is a sensor for detecting the termination of removing the slackness of ink sheet 14, the residual amount of ink sheet 14, or the conveying speed of ink sheet 14, by the use of a photo-interruptor in this example, in which the rotation of the ink sheet supply roller 17 is detected by sensing a slit 19*b* of a rotation plate 19*a* provided on a rotation shaft of the ink sheet supply roller 17 passing therethrough as shown in FIG. 4. 20 is an ink sheet sensor for detecting the presence or absence of ink sheet 14, and 21 is a spring for pressing the thermal head 13 via the recording sheet 11 and the ink sheet 14 against the platen roller 12. 22 is a recording sheet sensor for detecting the presence or absence of recording sheet.

Next, the constitution of the reading unit 100 will be described.

In FIG. 3, 30 is a light source for illuminating an original sheet 32, in which the light reflected from the original sheet 32 is passed through an optical system (mirrors 50, 201, lens 202) into a CCD sensor 31, and converted into an electrical signal. The original sheet 32 is conveyed in correspondence to a reading speed of the original sheet 32, by conveying rollers 53, 54, 55, 56 which are driven by an original conveying motor, not shown. Note that 57 is an original stack board, in which a plurality of original sheets stacked on the stack board 57 are separated into one sheet with the cooperation of a conveying roller 54 and a pressing/separating piece 58, and conveyed into the reading unit 100. 41 is a control substrate constituting a main portion of the control unit 101, from which various control signals are output to each unit of the apparatus. 106 is a modem substrate unit, and 107 is an NCU substrate unit.

FIG. 4 is a view showing the detail of a conveyance mechanism for the ink sheet 14 and the recording sheet 11.

In FIG. 4, 24 is a recording sheet conveying motor for rotating the platen roller 12 to convey the recording sheet 11 in the direction of arrow b opposite to the direction of arrow a. 25 is an ink sheet conveying motor for conveying the ink sheet 14 in the direction of arrow a by means of a capstan roller 71 and a pinch roller 72. Further, 26, 27 are transmission gears for transmitting the rotation of the recording sheet conveying motor 24 to the platen roller 12, and 73, 74 are transmission gears for transmitting the rotation of the ink sheet conveying motor 25 to the capstan roller 71. 75 is a slide clutch unit.

Here, the ink sheet 14 conveyed by the capstan roller 71 is securely wound around the take-up roll 18 by setting the ratio of gear 74 to gear 75*a* so that the length of the ink sheet 14 to be wound around the take-up roll 18 with the rotation of a gear 75*a* may be longer than the length of ink sheet to be conveyed by the capstan roller 71. And a difference between the amount of winding the ink sheet 14 around the take-up roll 18 and that of ink sheet 14 conveyed by the capstan roller 71 is absorbed by the slide clutch unit 75. Hence, it is possible to suppress the fluctuation in the conveying speed (amount) of ink sheet 14 owing to the variation of a take-up diameter of the take-up roll 18. 19 is a sensor for detecting the rotation amount of the ink sheet supply roller 17 as previously described, in such a way as to sense the slit 19*b* of the rotation plate 19*a* provided on the rotation shaft of the supply roller 17 passing there-through.

FIG. 1 is a diagram showing the electrical connections between the control unit 101 and the recording unit 102 in the facsimile terminal equipment of the example, wherein the like parts are indicated with the like numerals throughout the drawings.

The thermal head 13 is a line head. The thermal head 13 comprises a shift register 130 for inputting one line of serial recording data 43*a* or shift clock 43*b* from the control unit 101, a latch circuit 131 for latching data of the shift register 130 with a latch signal 44, and a heat generating element composed of one line of heating resistors 132. Here, the heating resistors 132 are divided into m blocks as indicated by 132-1 to 132-m, and driven for the generation of the heat. 133 is a temperature sensor to cause detecting the temperature of the thermal head 13. An output signal 42 of the temperature sensor 133 is converted from analog to digital form within the control unit 101 and input into the CPU 113. Thereby, the CPU 113 can detect the temperature of the thermal head 13 so as to alter vary the applied energy to the thermal head 13 in accordance with the characteristics of the ink sheet by changing the pulse width of a strobe signal 47 in correspondence to its temperature via a driving circuit 46, or changing the driving voltage of the thermal head 13. 116 is a programmable timer in which the timer is set by the CPU 113 and started if the start of timer is instructed. And it operates to output an interrupt signal or time-out signal to the CPU 113 at each indicated timing.

It should be noted that the type or characteristic of ink sheet 14 can be determined by a switch 103*a* on the operation unit 103 as previously described, or a mark printed on the ink sheet 14, or a mark or cut-out attached to a cartridge for the ink sheet.

46 is a driving circuit for inputting a drive signal for the thermal head 13 from the control unit 101, and outputting a strobe signal 47 for driving the thermal head 13 for each block. It should be noted that this driving circuit 46 can change the amount of energy applied to the thermal head 13, by changing the voltage output to a power source line 45 for supplying current to the heating elements 132 within the thermal head 13, with an indication from the control unit 101. 36 is a driving circuit for driving a cutter 15 mating therewith, comprising a motor for driving the cutter. 39 is a paper discharge motor for rotating the paper discharge rollers 16. 35, 48 and 49 are driver circuits for driving and rotating a motor 39 for discharge recording sheets, a motor 24 for conveying recording sheets, a motor 25 for conveying ink sheets, respectively. It should be noted that each of sheet discharge motor 39, recording sheet conveying motor 24 and ink sheet conveying motor 25 are stepping motors in this example, but not limited to it, and DC motors, for example, may be used.

Next, the removal of the slackness for ink sheet, which is performed prior to the recording process, will be described, before describing the recording process of the facsimile terminal equipment in this example.

The purpose of removing the slackness of ink sheet 14 will be first explained. With the facsimile terminal equipment in this example, the conveyance speed of ink sheet 14 in recording is 1/n (e.g., n=5) that of recording sheet 11, and the ink sheet 14 and the recording sheet 1 are conveyed in opposite directions to each other. At this point, if the ink sheet 14 has a slackness, the ink sheet 14 can not be conveyed in the recording operation, so that the ink sheet is consecutively heated at the same position. In such a case, the recording operation is performed in the condition where the ink sheet 14 and the recording sheet 11 may be adhered, or the ink sheet 14 may be pulled by the recording sheet 11 if there is an amount of slackness for the ink sheet 14, whereby the recording quality may be degraded.

In order to record an image with a high quality from a leading end of the recording sheet 11 by preventing such a situation, the slackness removal of ink sheet 14 (thereinafter referred to as a macro slackness removal) is performed prior to recording of one page, and the slackness removal of ink sheet 14 (thereinafter referred to as micro slackness removal) is performed immediately before the recording.

Figure 5:
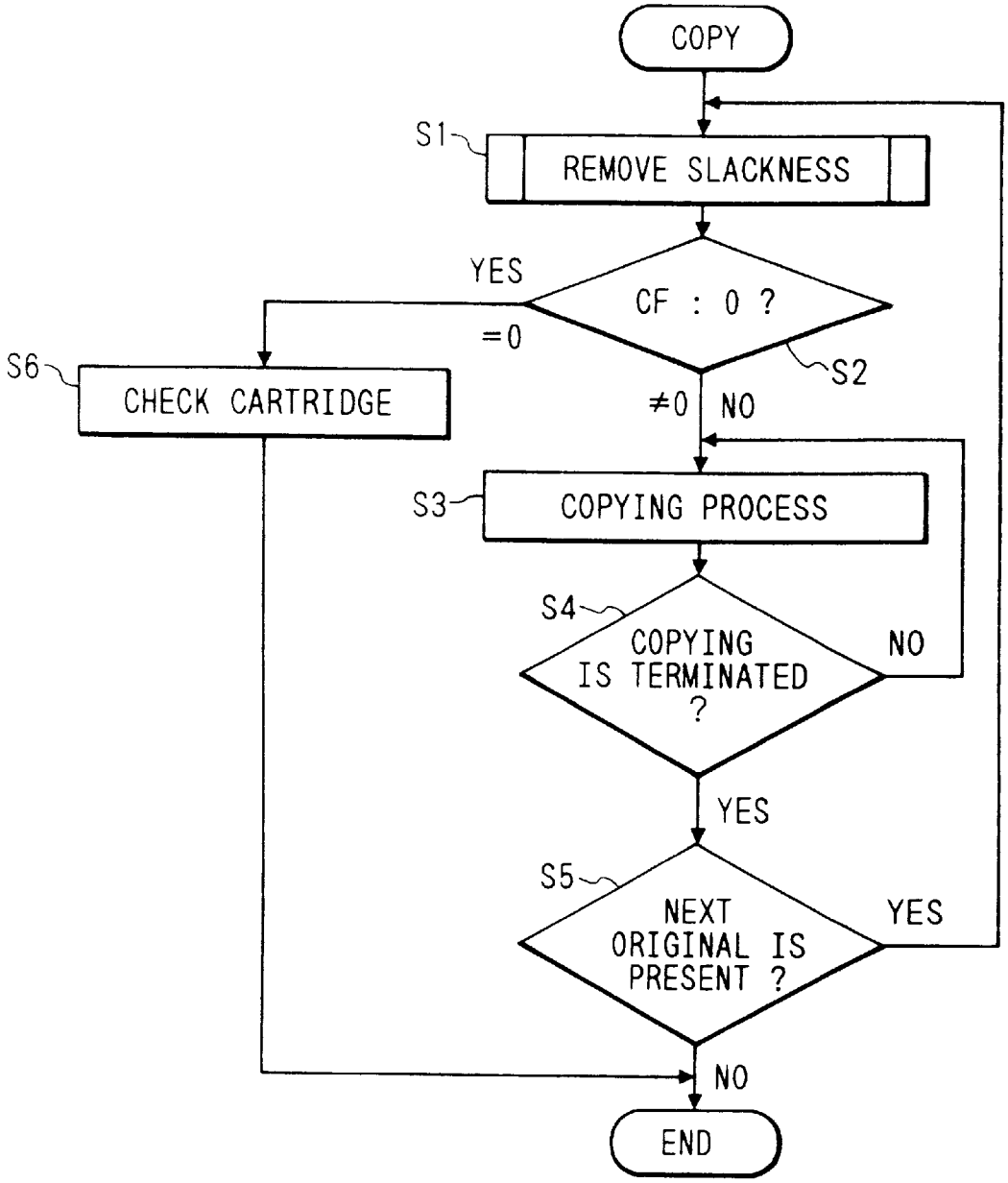
FIG. 5 is a flowchart showing a copy operation in the facsimile terminal equipment of the example 1.

FIG. 5 is a flowchart showing the processing of the control unit 101 copying, wherein the slackness removal of ink sheet in this example is described on the basis of a copying process. Note that at the output of memory copy, G2 reception, MF1 reception, intercepting in a typical facsimile terminal equipment, the slackness of ink sheet is also removed in the same way.

In FIG. 5, if the copying operation is indicated, the operation proceeds to step Sl, where the slackness of ink sheet 14 is removed. This processing will be described in detail with reference to the flowcharts of FIGS. 6 and 7. Next, the operation proceeds to step S2, where a determination is made whether or not a flag CF of RAM 115 is "0", i.e., the ink sheet 14 is absent, or the slackness of ink sheet has not been removed because of the absence of the ink sheet cartridge. If the flag CF is "0", the operation proceeds to step S6, where a message of checking the ink sheet cartridge is displayed on an indication unit 104, and the operation is terminated. On the other hand, if the flag CF is not "0" at step S2, i.e., both the ink sheet 14 and the ink sheet cartridge are present, and the slackness of ink sheet has been removed, the operation proceeds to step S3, where the copying operation is performed.

Next, the operation proceeds to step S4, where a determination is made whether or not the copying operation is terminated. If the copying operation is not terminated, the operation returns to step S3 for the copying operation, while if the copying operation is terminated, the operation proceeds to step S5, where a determination is made whether or not a next original to be copied is present. If the next original is present, the operation returns to step S1, where the slackness of ink sheet 14 is removed, and then the copying operation for the next original is performed.

Figures 6, 6A:
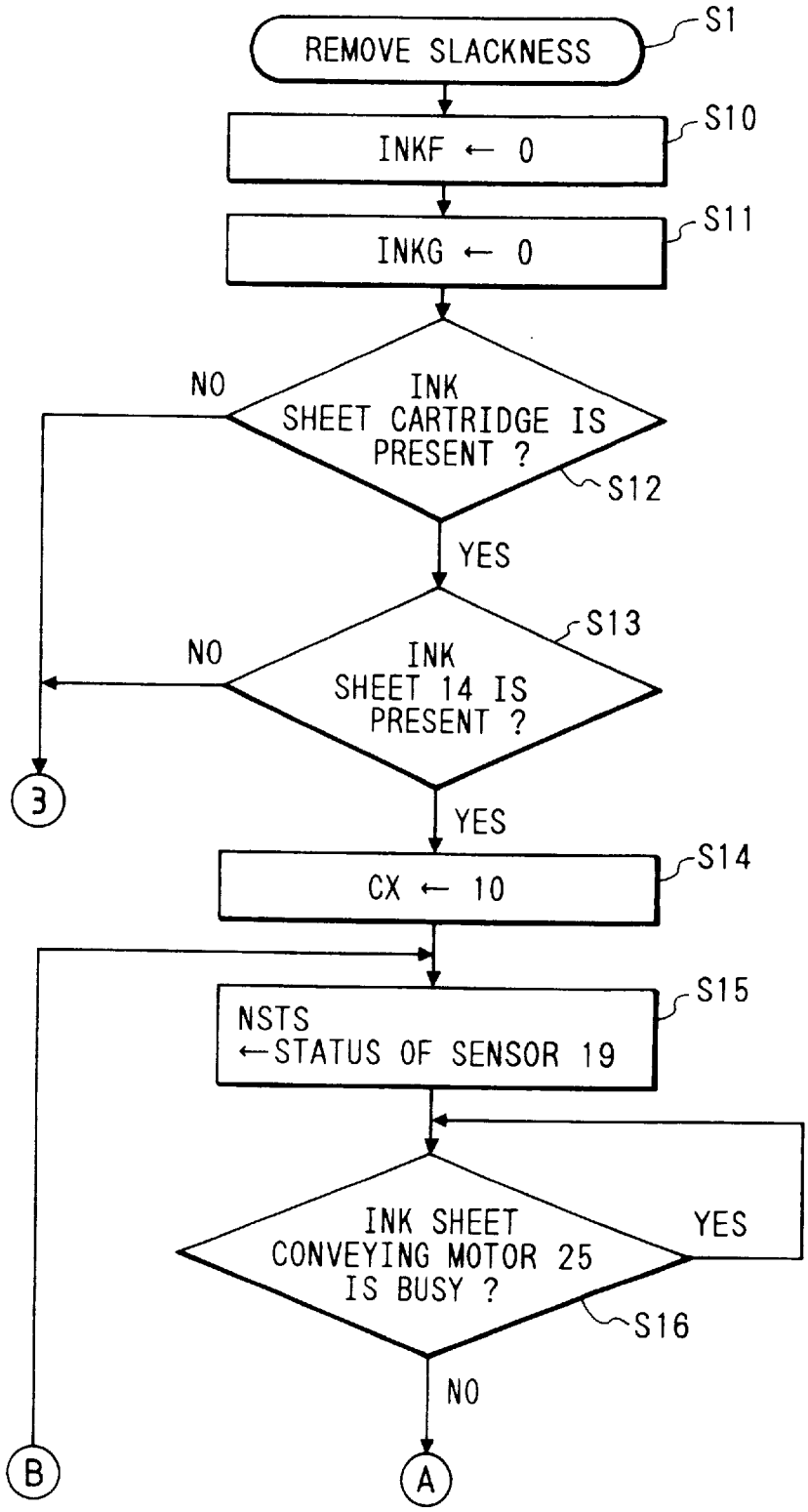
FIGS. 6, 6A, 6B and 7 are flowcharts showing an operation of removing the slackness of the ink sheet in the facsimile terminal operation of the example 1.
Figure 7:
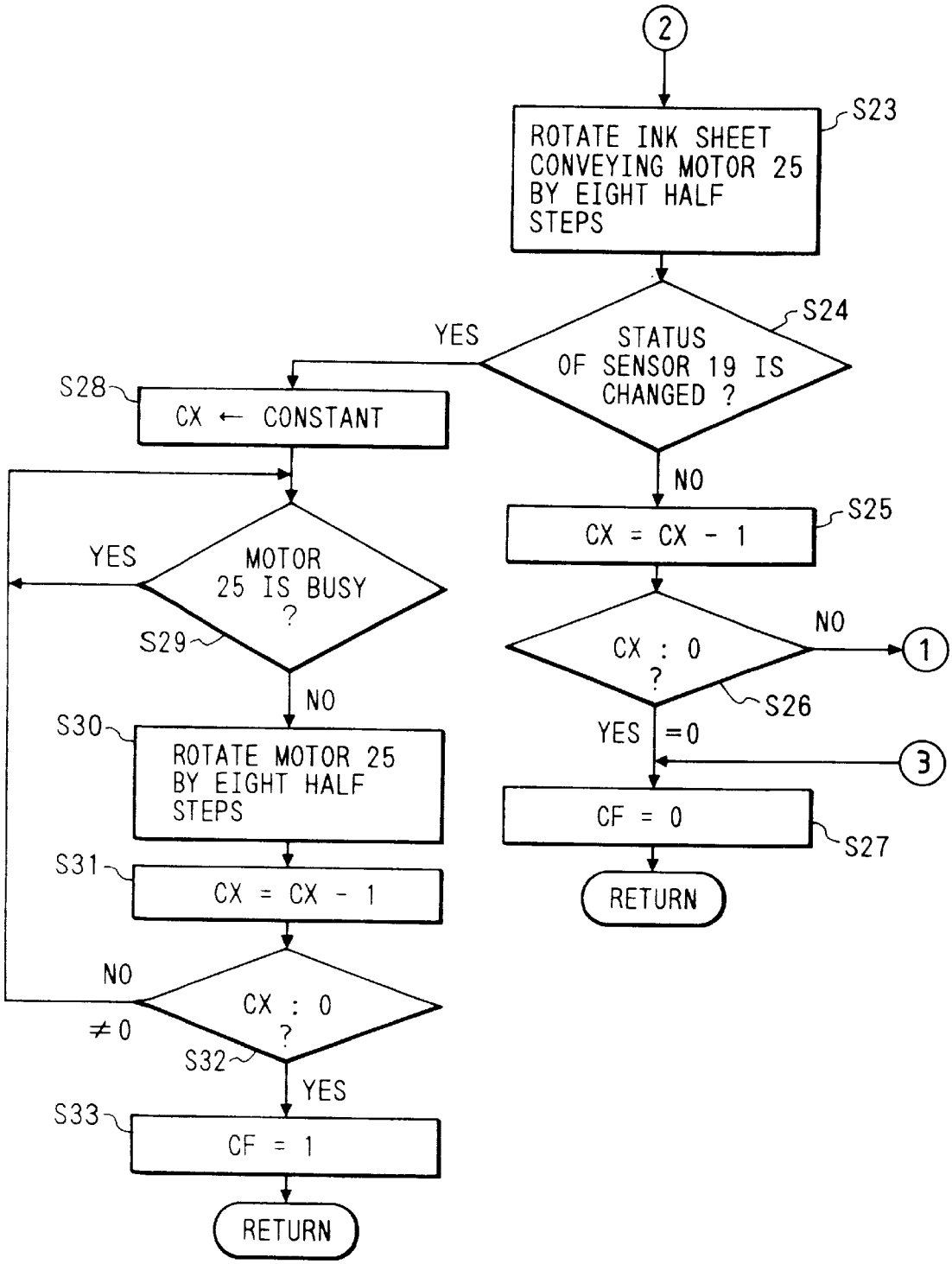

FIGS. 6 and 7 are flowcharts showing a slackness removal process of the ink sheet 14 as shown at step S1 of FIG. 5.

First, at steps S10, S11, flags INKF, INKG (both existing within the RAM 115) for the removal of the slackness for the ink sheet 14 to be used at the G3 transmission are cleared to "0". Next, the operation proceeds to steps S12, S13 for the determination of the presence or absence for an ink sheet cartridge and the ink sheet 14, in which if either of them is absent, the slackness of ink sheet is not removed because of incapability of recording with recording means, and the operation proceeds to step S27, where the flag CF is set to "0", and returns to a main routine.

At step S14 to S20, a check is made to determine whether or not the state of the slit 19*b* of the rotation plate 19*a* detected by the sensor 19 is equal to the value stored in NSTS which is a storage area of the RAM 115, every time the ink sheet conveying motor 25 is rotated by eight half steps. If it is not equal, this operation is repeated 10 times, and then the operation proceeds to step S21. Note that the rotational speed of the ink sheet conveying motor 25 at step S17 is 1200pps.

Next, proceeding to step S21, a maximum value (1596 here) is set to a counter CX of the RAM 115, and at step S23, the ink sheet conveying motor 25 is rotated at 1200 pps by eight half steps. At step S24, a determination is made whether or not the output state of the sensor 19 has been changed by the comparison between the state of the sensor 19 stored in the RAM 115 and a current output value of the sensor 19. Thus, if the state of output value from the sensor 19 may be changed by the time when the ink sheet conveying motor 25 is rotated 1596 times, the operation proceeds to step S28, or otherwise the operation proceeds to step S27, where the flag CF of the RAM 115 is set to "0", and returns to an original routine.

At step S28, a predetermined value (or 24 here) is set to the counter CX, and at step S30, the ink sheet conveying motor 24 is rotated at 400 pps by eight half steps. The micro slackness removal is performed by repeating this process by a value of the counter CX (24 times). If this process is terminated, the operation proceeds to step S33, where the flag CF is set to "1", and returns to original routine.

Next, the G3 reception and the ECM reception in the intermittent receiving operation, and the G3 reception in the constant speed receiving operation will be described.

FIGS. 8 to 24 are flowcharts showing the control process for the G3 reception and the ECM reception in the intermittent receiving operation, and the G3 reception in the constant speed receiving operation.

Figure 8:
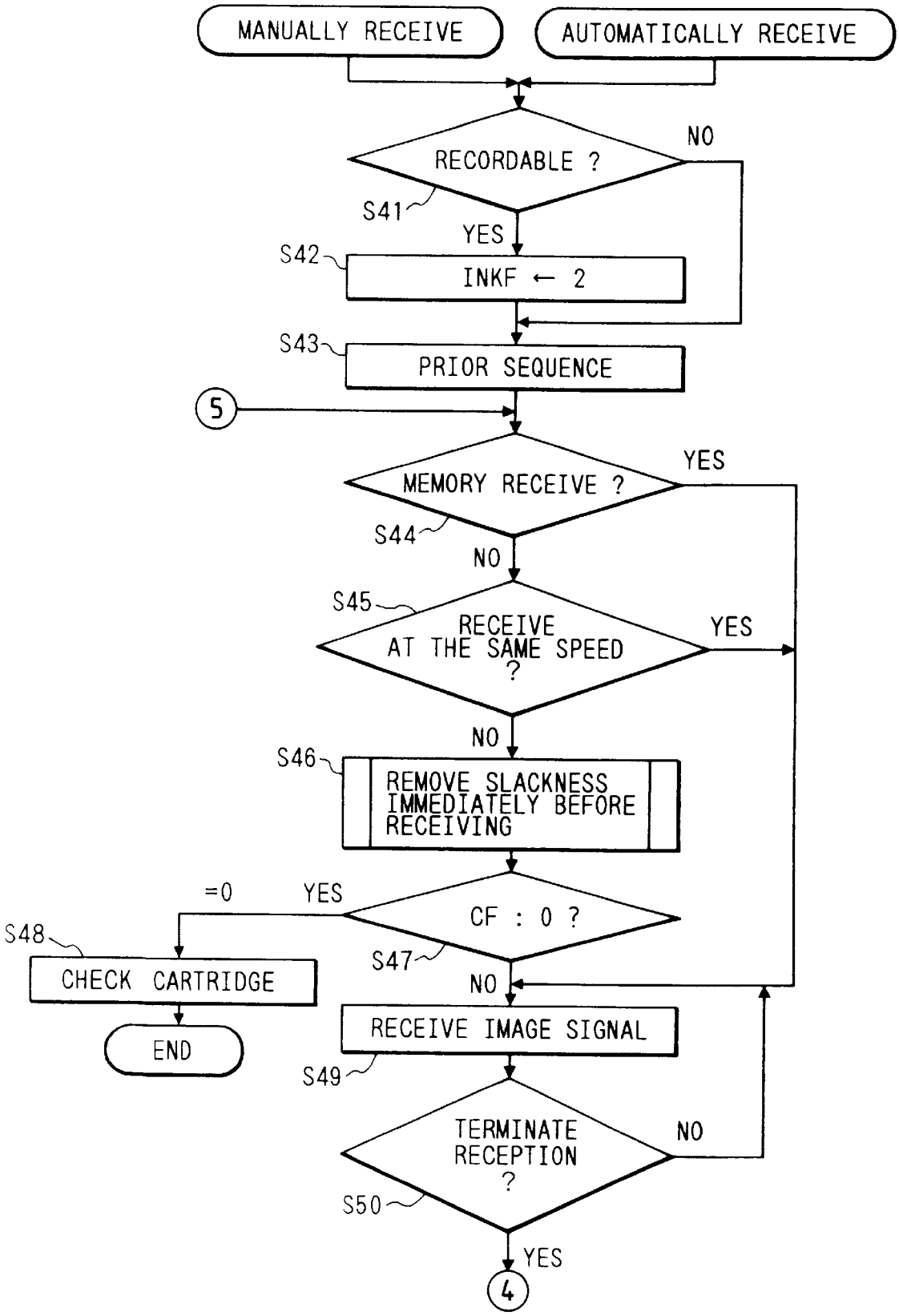
FIGS. 8 and 9 are flowcharts showing processing in manual reception and automatic reception.
Figure 9:
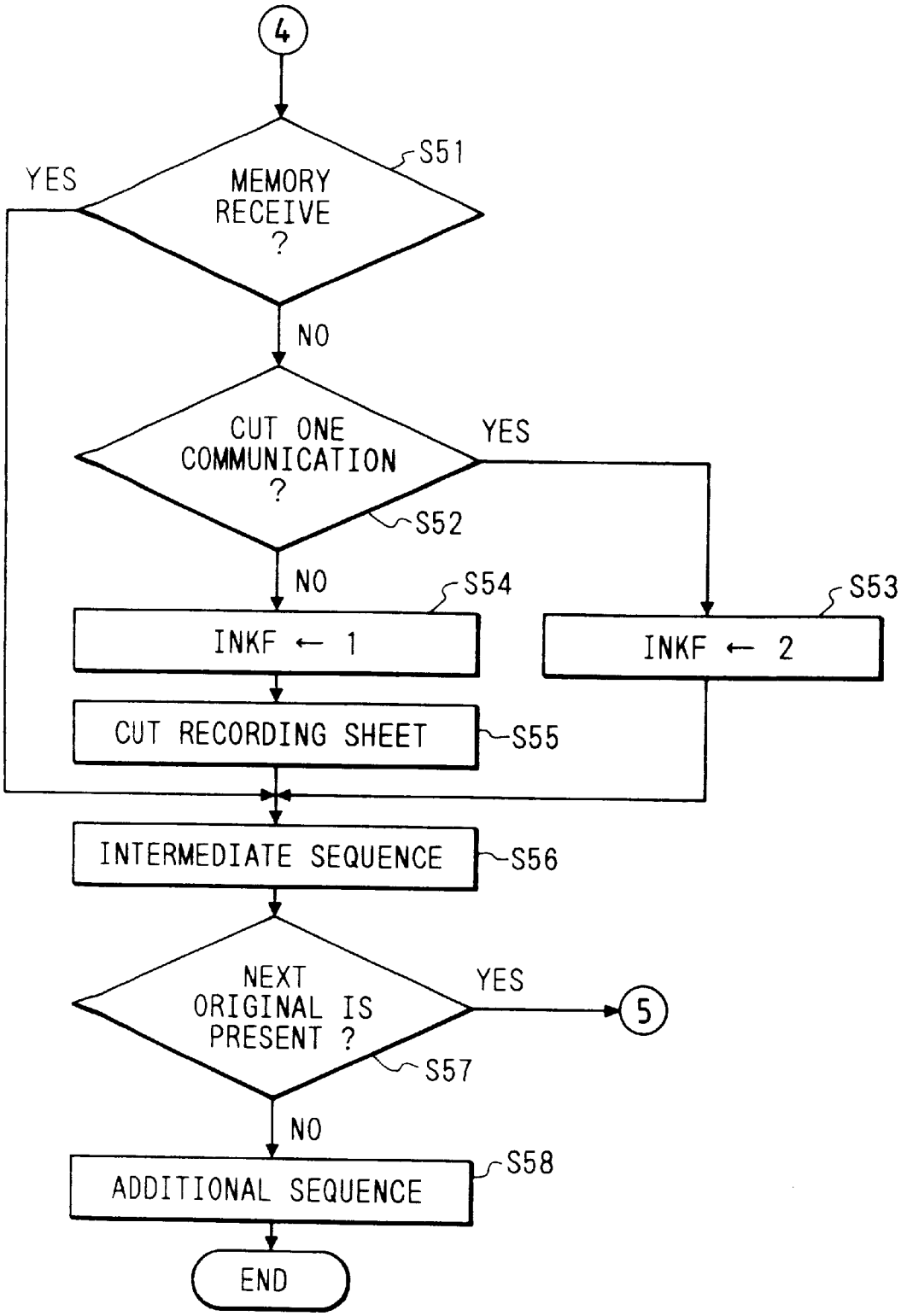

In FIG. 8, if the manual reception or automatic reception is started, the operation proceeds to step S41 for the determination of whether or not the apparatus is recordable. If it is recordable, the operation proceeds to step S42, where the flag INKF of the RAM 115 is set at "2". If the flag INKF is set at "2", the slackness of ink sheet 14 is removed with an ink sheet conveyance control (INKCTL) routine (as shown in the flowcharts of FIGS. 13 to 20) which is called by an interrupt routine up to 10 ms.

In this way, the slackness of ink sheet is removed prior to receiving the image signal, if recordable condition is determined. This slackness removal is also carried out during prior sequence at step S43. Therefore, the total time needed from the start of manual reception or automatic reception to the start of actual recording is shortened as compared with the instance where the slackness of ink sheet is removed after receiving the image signal, so that there are the effects that the recording can be made more efficiently, and reception errors caused by the delay of recording preparation may be less likely to occur.

On the other hand, if the operation is not recordable, the slackness of ink sheet is not removed. This is to prevent the waste of ink sheet from occurring. And if the slackness of ink sheet is removed with no recording sheet, the platen may be contaminated by the ink, or the ink sheet may be damaged. Further, even if the slackness of ink sheet is removed with a recording cover being opened, it is meaningless because the ink sheet may be slacked when the recording cover is closed afterwards.

Figure 22:
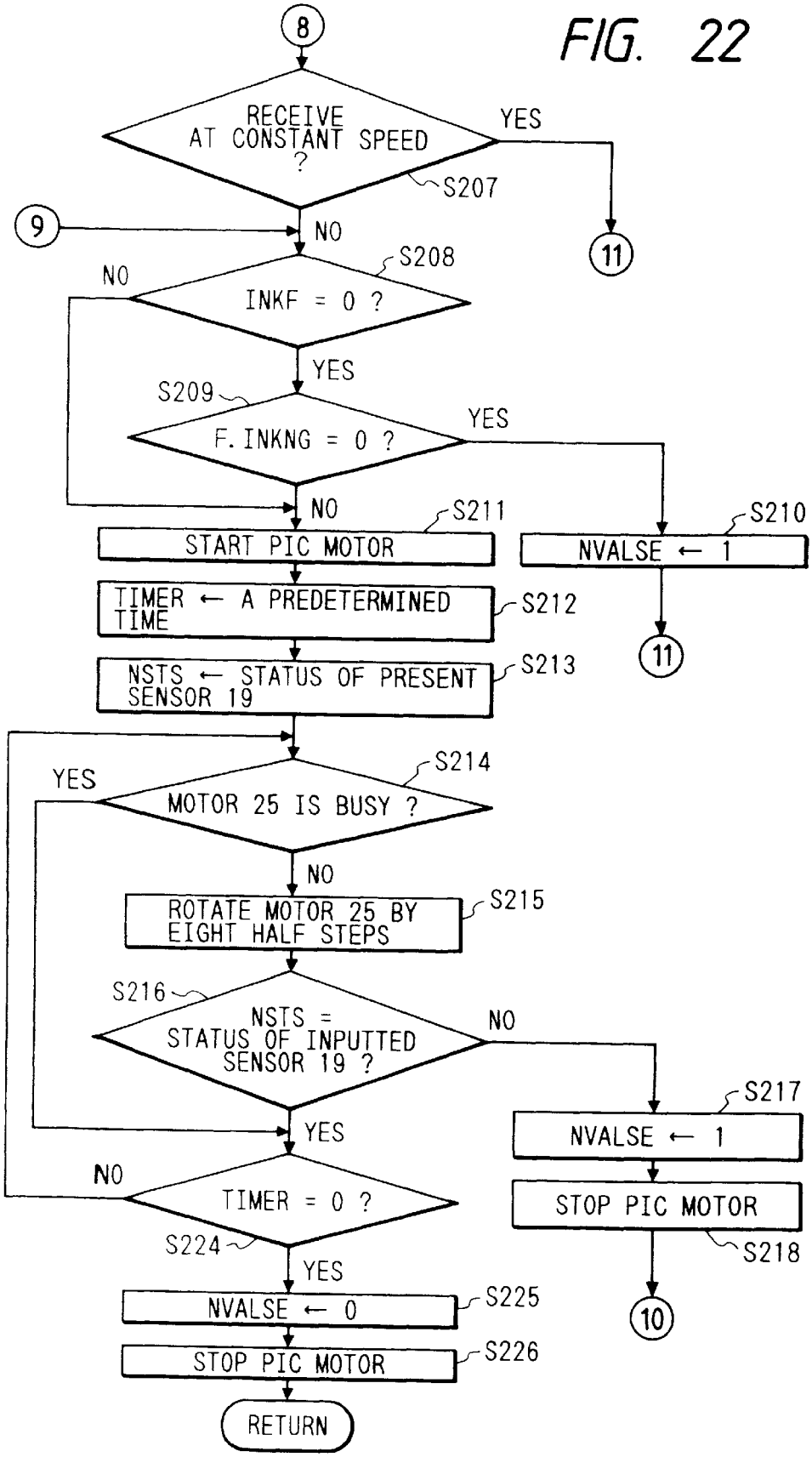
Figure 23:
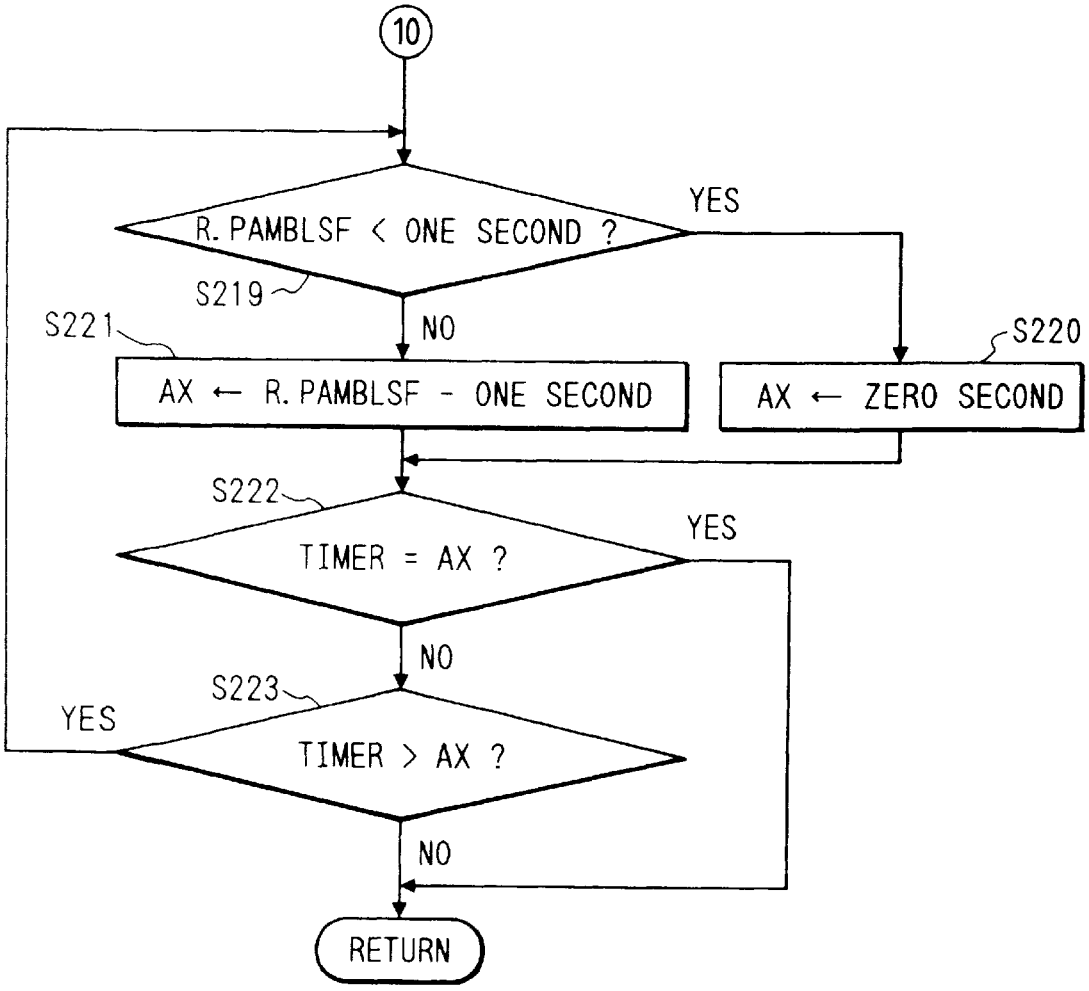

If the apparatus is not recordable at step S41, the operation proceeds to step S43 for performing a prior sequence which is a procedure of declaring its own function before transmitting the image signal, or changing the transmission mode. Here, at the transmission of procedure signal, a preamble signal is transmitted by a preamble transmission routine (as shown in FIGS. 21 to 23).

Next, proceeding to step S44, a determination is made whether or not the memory is received (e.g., reception at other site). If the memory is received, the operation proceeds to step S49, the slackness of ink sheet is not removed. This is because the ink sheet is wasted by removing the slackness of ink sheet as the recording is not made at the memory reception. If the memory is not received, the operation proceeds to step S45 for the determination of whether or not the reception is made at the constant speed. Here, the constant speed reception is one in which two buffers for storing 256 lines of raw data (which are also used for the ECM buffer) are prepared to store decoded raw data upon reception in sequence. And at the time when 256 lines of raw data have been stored, 256 lines of data are recorded at the constant speed. With this constant speed recording, the image quality can be improved, but it takes an excess time to store raw data in up to one buffer from the termination of receiving the image signal to the termination of recording, resulting in a longer recording time. Therefore, in receiving one page, an MCF signal is sent out when one page of recording is ended, while the cut operation of recording sheet or the slackness removal of ink sheet 14 is terminated until 256 lines of data have been stored into the next buffer. Thus, the preamble for sending out the MCF signal is 1 second.

The operation proceeds to step S49 if the reception is made at constant speed, or otherwise to step S46. At step S46, the micro slackness of ink sheet immediately before receiving the image signal is removed. Next, proceeding to step S47, a determination is made whether or not the slackness removal of ink sheet is excellent (or CF=1), in which if it is excellent (CF=1), the operation proceeds to step S49, or otherwise (CF=0) to step S48, where a message of checking the ink sheet cartridge is displayed, and the process is terminated.

Figure 11:
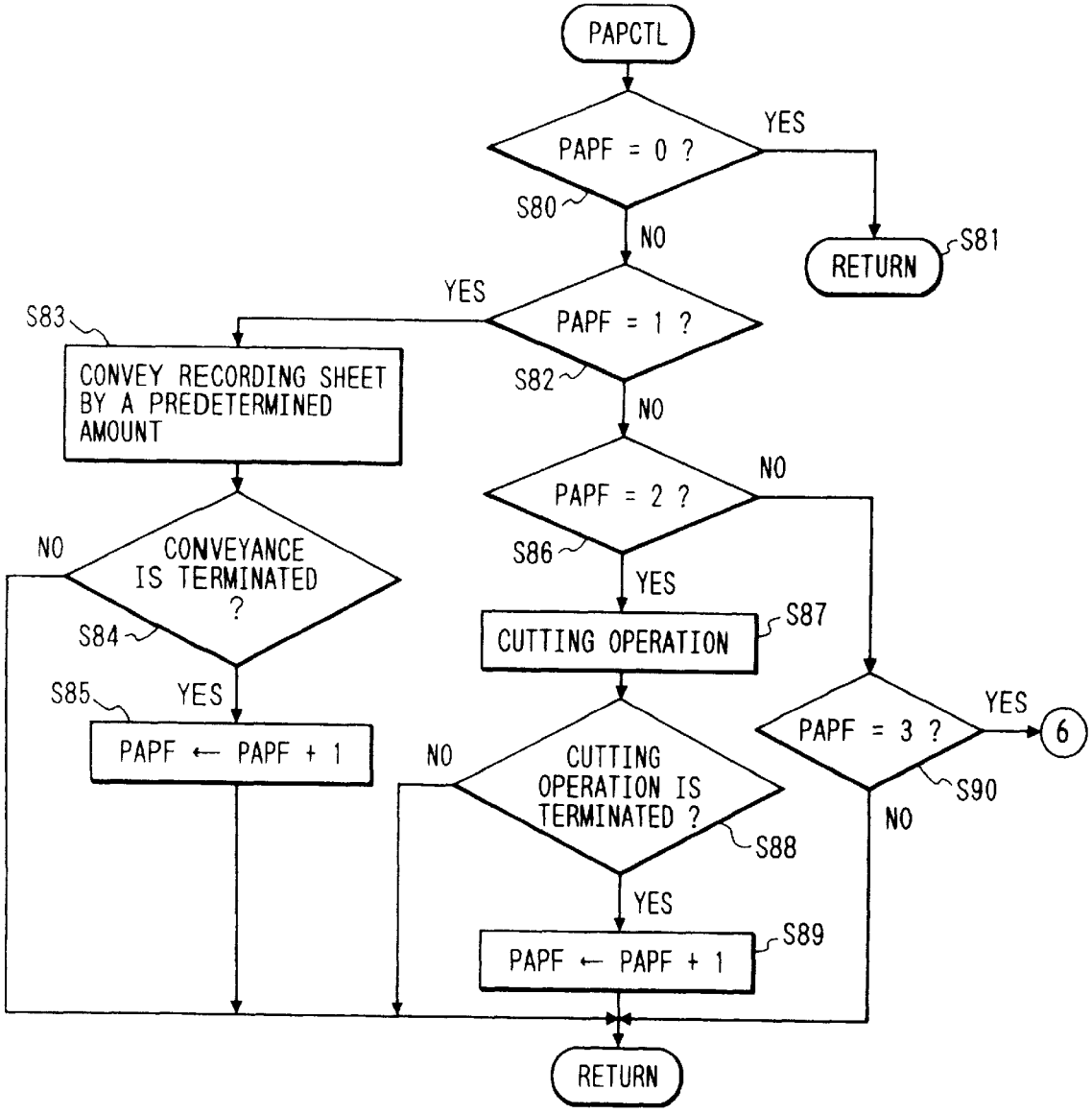
FIGS. 11 and 12 are flowcharts showing the conveyance control for the recording sheet in the facsimile terminal equipment of the example 1.
Figure 12:
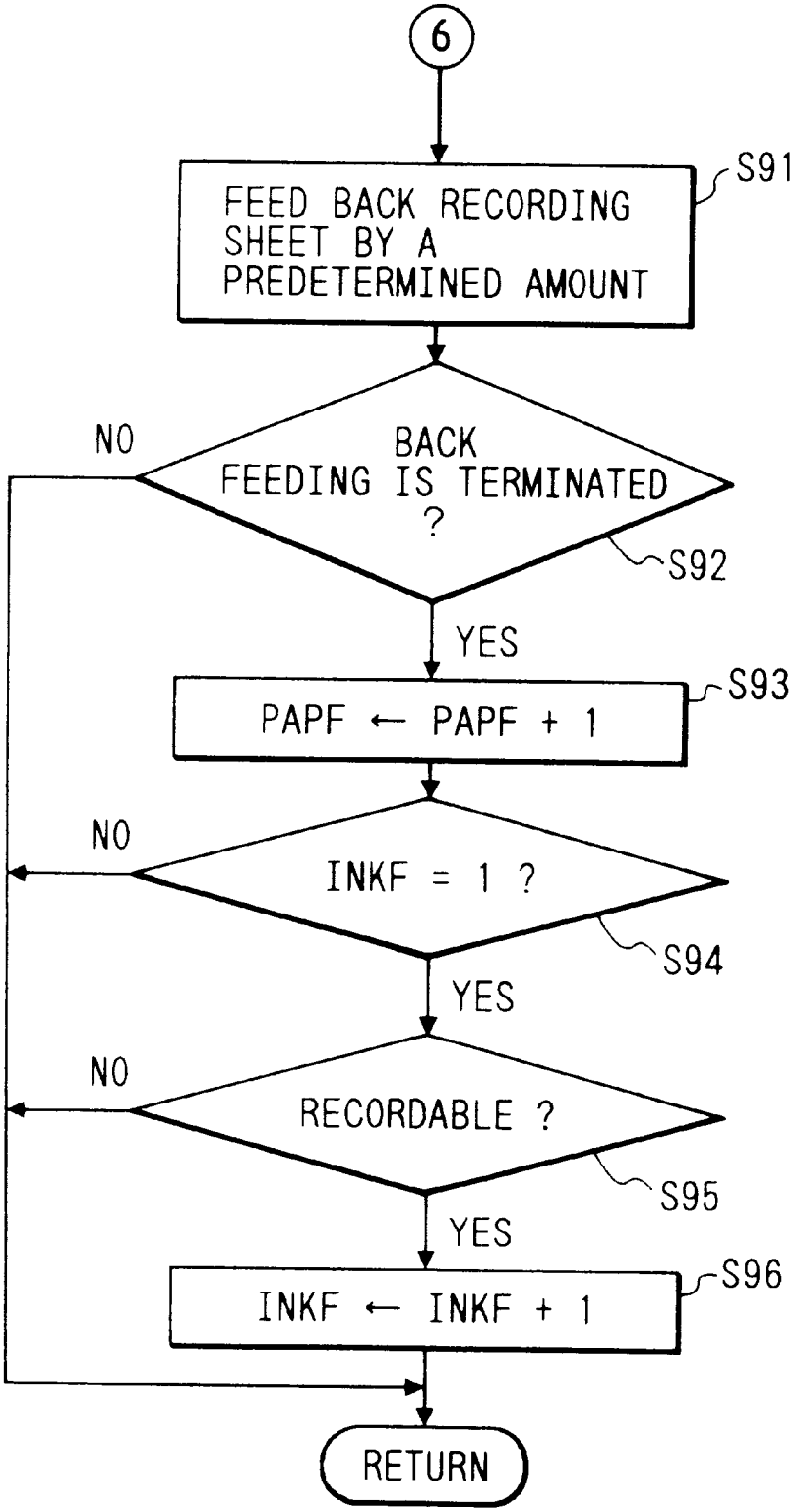

At step S49, S50, the image signal is received. If the memory is received at step S51, the operation proceeds to step S56, as the slackness removal of ink sheet 14 and the cut operation are not performed, while if the memory is not received, the operation proceeds to step S52. If the mode is one in which the recording sheet is cut at the breakpoint of one communication, but not the separation of page, namely, one communication cut, at step S52, the operation proceeds to step S53, where the flag INKF is set at "2" to remove the slackness of ink sheet for each page with an INKCTL routine, and the operation proceeds to step S56. In this way, the slackness of ink sheet is removed even during the facsimile control procedure, or the procedure involved in the transmission and reception of signal. On the other hand, if the mode is not one communication cut at step S52, the operation proceeds to step S54, where the flag INKF is set at "1", and the cut operation of recording sheet 11 is performed at step S55. Here, the cut operation of recording sheet is performed by a PAPCTL routine (as shown in FIGS. 11 and 12) which is called by an interrupt routine for every 10 ms. If the flag INKF is "1" when the cut operation of recording sheet 11 is completed by a recording sheet conveyance control (PAPCTL) routine, the flag INKF is incremented by +1, resulting in the value of the flag being "2", and the slackness of ink sheet is removed by the INKCTL routine.

At step S56, an intermediate sequence for processing the MPS signal to be output when the mode such as an original size or fine mode is changed, the EOM signal to be output when such change is not made, or the EOP signal indicating the final page is performed, and at step S57, a check is made to determine whether or not the next original is present. If the next original is present, the operation returns to step S44, where previously-mentioned processings are repeated. On the other hand, if the next original is not present, the operation proceeds to step S58, where an additional sequence which prepares for the transition to a line disconnection is performed, and the operation is terminated.

As above described, the parallel processing is allowed by removing the slackness of an ink sheet even during the facsimile control procedure, i.e., during the procedure involved in the transmission and reception of signal, so that the time required to commence the image recording can be shortened, with a shorter waiting time and a more efficient recording.

Figure 10:
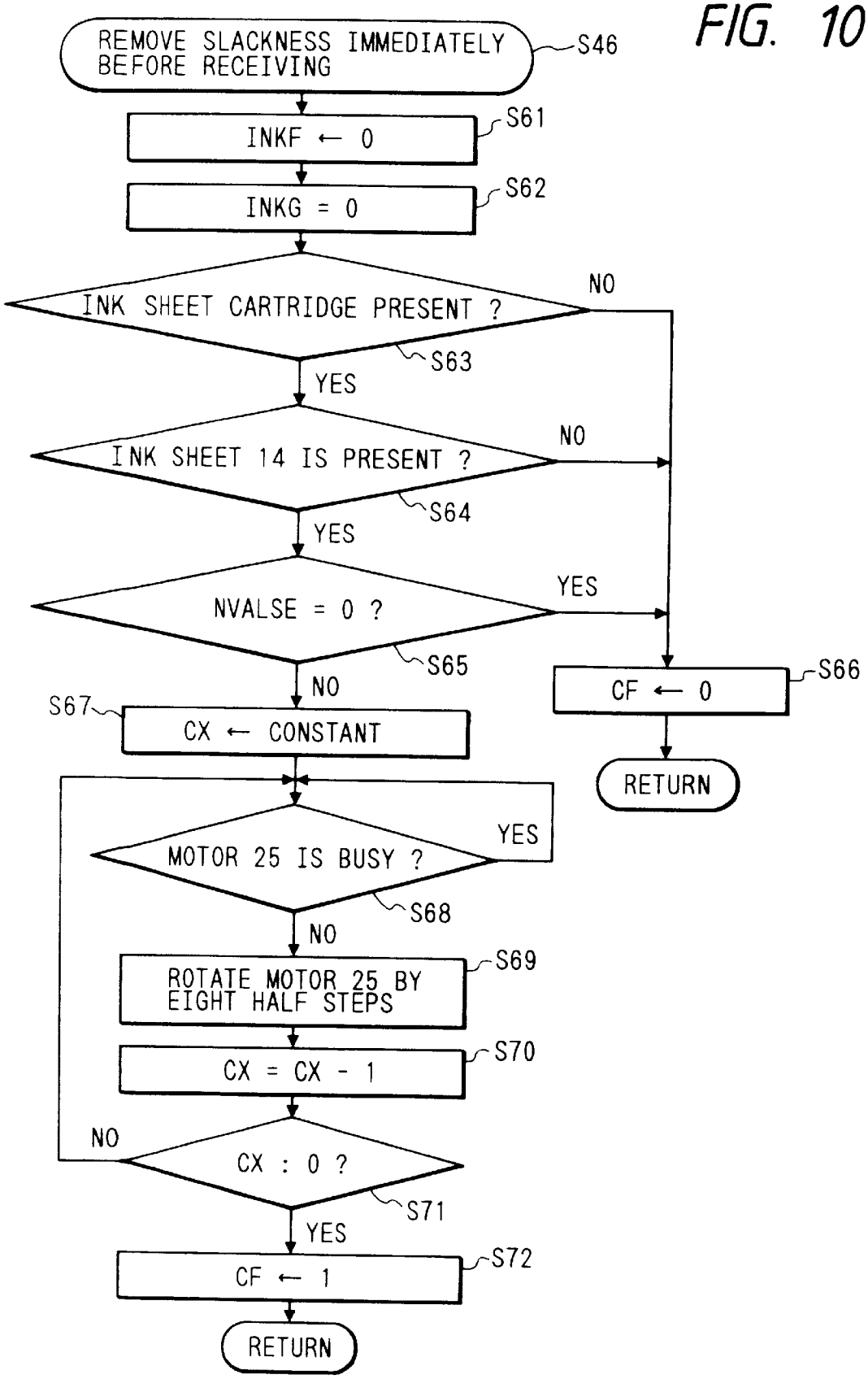
FIG. 10 is a flowchart showing the removal of ink sheet slack immediately before receiving.

FIG. 10 is a flowchart showing a process of removing the slackness of ink sheet immediately before receiving the image signal.

When the ink sheet cartridge or ink sheet 14 is not present, or when the slackness removal of ink sheet has not been completed (NVALSE=0 at the transmission of preamble with the interrupt routine, the operation proceeds to steps S66, where the flag CF is set at "0", and returns to the original routine.

At step S67, a predetermined value (24 here) is set to the counter CX, and at step S69, the ink sheet conveying motor 25 is rotated by eight half steps. This processing is repeated by the times equal to the value of the counter CX, the micro slackness removal of ink sheet is carried out. And proceeding to step S72, the flag CF is set at "1", and then the operation returns to the original routine.

FIGS. 11 and 12 are flowcharts showing a process for the recording sheet conveyance control (PAPCTL) which is activated by an interrupt signal to be output by a timer 116 at intervals of 10 ms.

Figure 13:
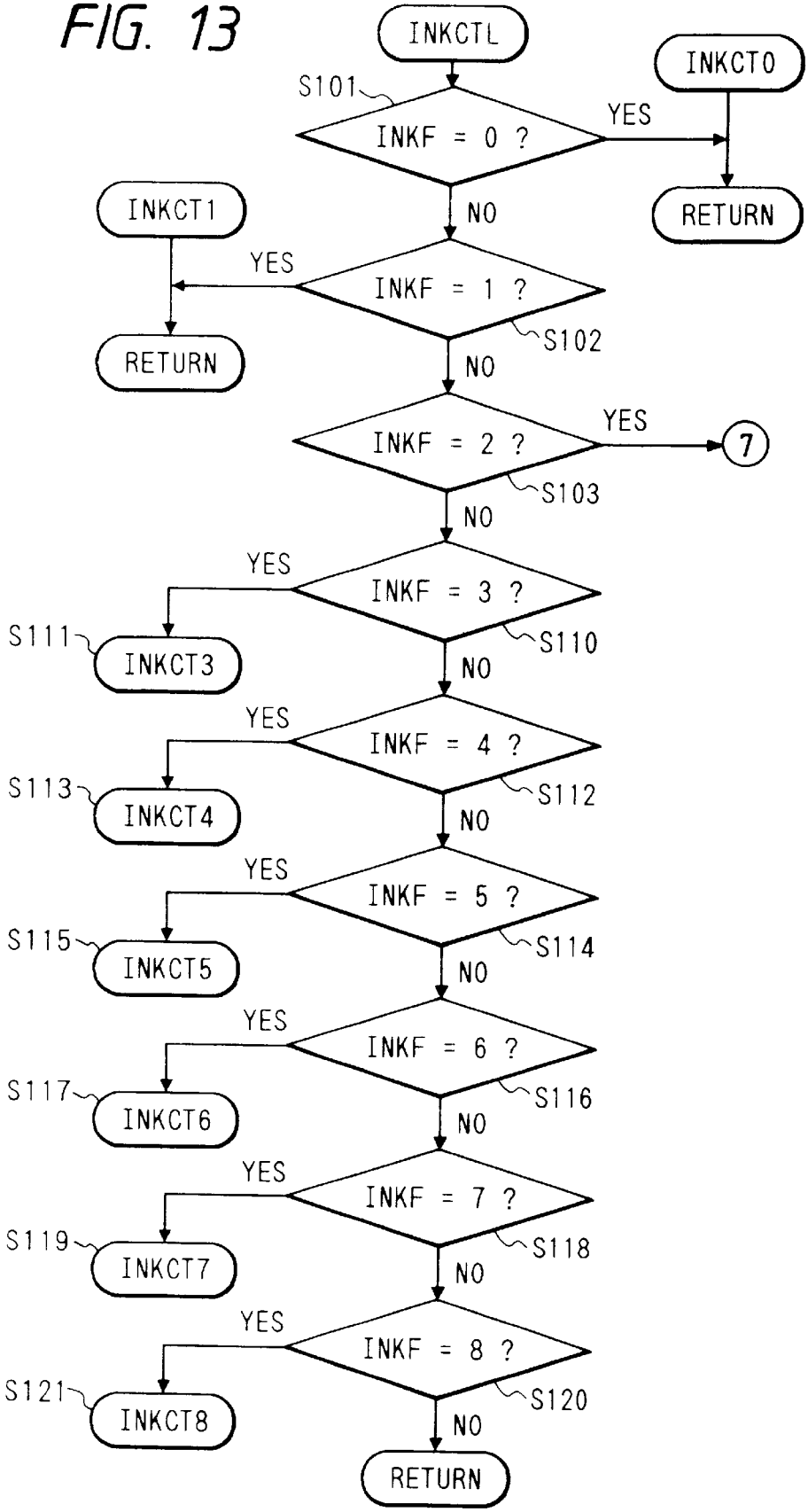
FIGS. 13 to 20 are flowcharts showing the conveyance control for the ink sheet.
Figure 14:
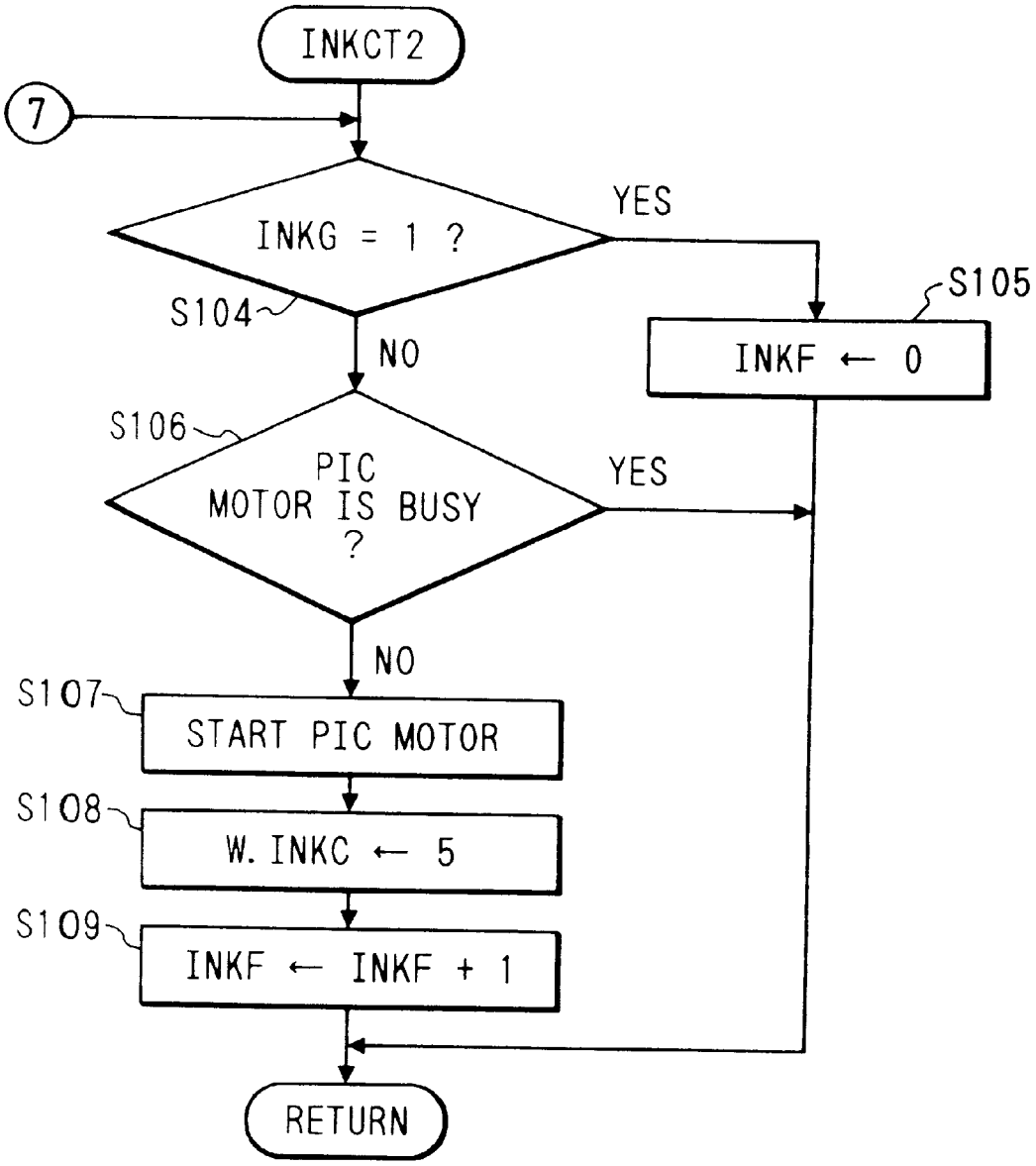

Here, when an interruption occurs for every 10 ms, the cut operation of recording sheet 11 is performed if the flag PAPF of the RAM 115 has "1". And if the flag INKF is "1" upon termination of the cut operation, it is incremented by +1, resulting in the flag INKF being 2. Thereby, the slackness of ink sheet is removed by the INKCTL routine as shown in FIGS. 13 and 14.

First, proceeding to step S80, if the flag PSPF is "0", no processing is performed, and the operation returns to the original process. If the flag PSPF is "1" at step S82, the operation proceeds to step S83, where the recording sheet 11 is conveyed by a predetermined direction in a forward direction. If this conveyance is terminated at step S84, the operation proceeds to step S85, where the flag PSPF is incremented by +1, resulting in "2". If the flag PAPF is "2", the operation proceeds to step S87, where the cut operation of recording sheet 11 is performed. If the cut operation is terminated, the operation proceeds to step S89, where the flag PAPF is incremented by +1, resulting in "3".

If the flag PAPF is "3" at step S90, the operation proceeds to S91, the recording sheet is fed back by a predetermined amount. If the back feed processing is terminated, the operation proceeds from step S92 to step S93, where the flag APAF is incremented by +1, resulting in "4". Then if the flag INKF is "1" at step S94, and if the operation is recordable at step S95, the operation proceeds to step S96, where the flag INKF is incremented by +1, resulting in "2". Thereby, the slackness of ink sheet is removed by the INKCTL routine as shown in FIGS. 13 and 14. Note that the PAPCTL routine returns to the original routine if the flag PAPF is equal to or greater than "4".

FIGS. 13 to 20 show flowcharts for the ink sheet control (INKCTL) activated by an interrupt signal at periods of 10 ms, which is produced based on the timing by the timer 116.

At steps S101 and S102, if the flag INKF is "0" or "1", no processing is made. If the flag INKF is "2" at step S103, the operation proceeds to step S104, where a determination is made whether or not the flag INKF is "1", in which if the answer is yes, the flag INKF is set at "0" at step S105 to stop the slackness removal of ink sheet. On the other hand, if the flag INKG is "0" at step S104, the operation proceeds to step S106. If the PIC motor (recording sheet conveying motor 24, ink sheet conveying motor 25 and cutter driving motor) is confirmed not to be busy, the PIC motor is started at step S107. Note that PIC is an acronym representing the term Platen, Ink sheet and Cutter. And the flag W.INKC of the RAM115 is set at "5", the flag INKF is incremented by +1, resulting in "3".

Figure 15:
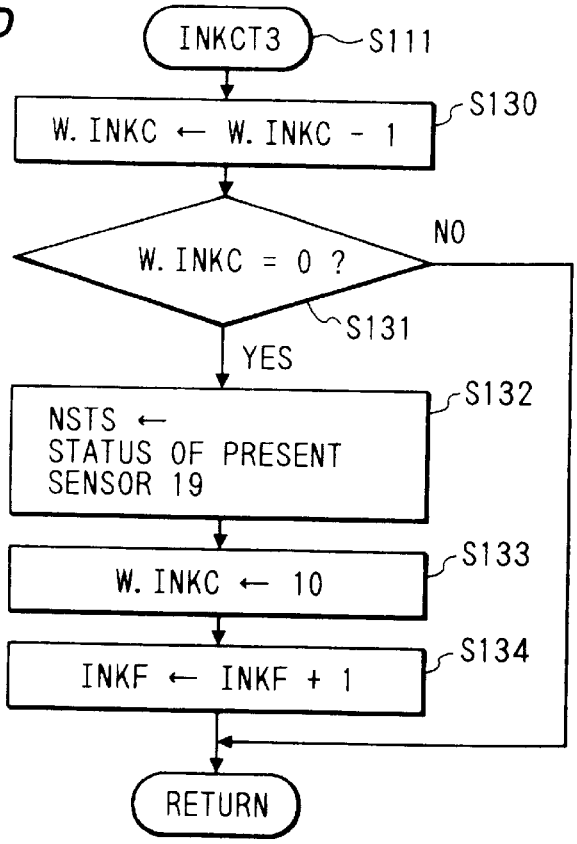

If the flag INKF is "3", the operation proceeds from step S110 to step S130 in FIG. 15, where the flag W.INKC is decremented by 1, and if the flag W.INKC is "0" at step S131, i.e., after 50 ms has been passed, the operation proceeds to step S132, where a current value of sensor 19 is input and stored in NSTS of the RAM 115. And the flag W.INKC IS SET AT "10" at step S133, and then INKF is incremented by +1 at step S134, resulting in "4".

Figure 16:
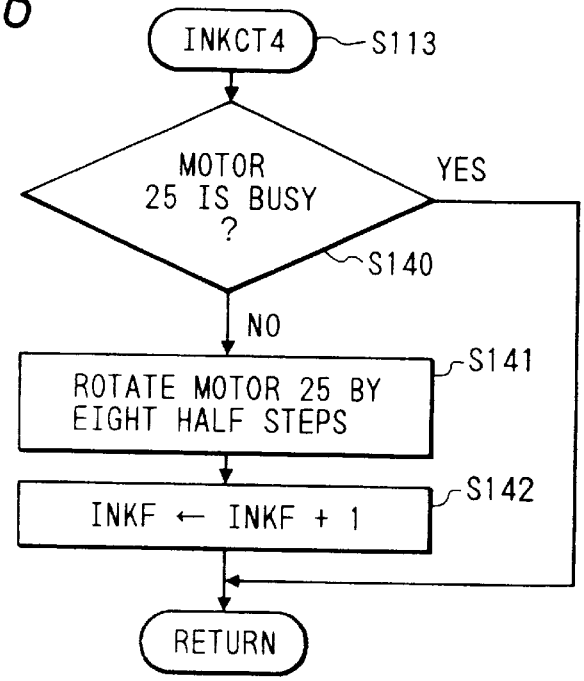

If the flag INKF is "4"at step S112, the operation proceeds to step S140, as shown in FIG. 16, where a determination is made whether or not the ink sheet conveying motor 25 is busy. If not busy, the ink sheet conveying motor 25 is rotated by eight half steps at 400 pps. Then at step S142, the flag INKF is set at "5".

Figure 17:
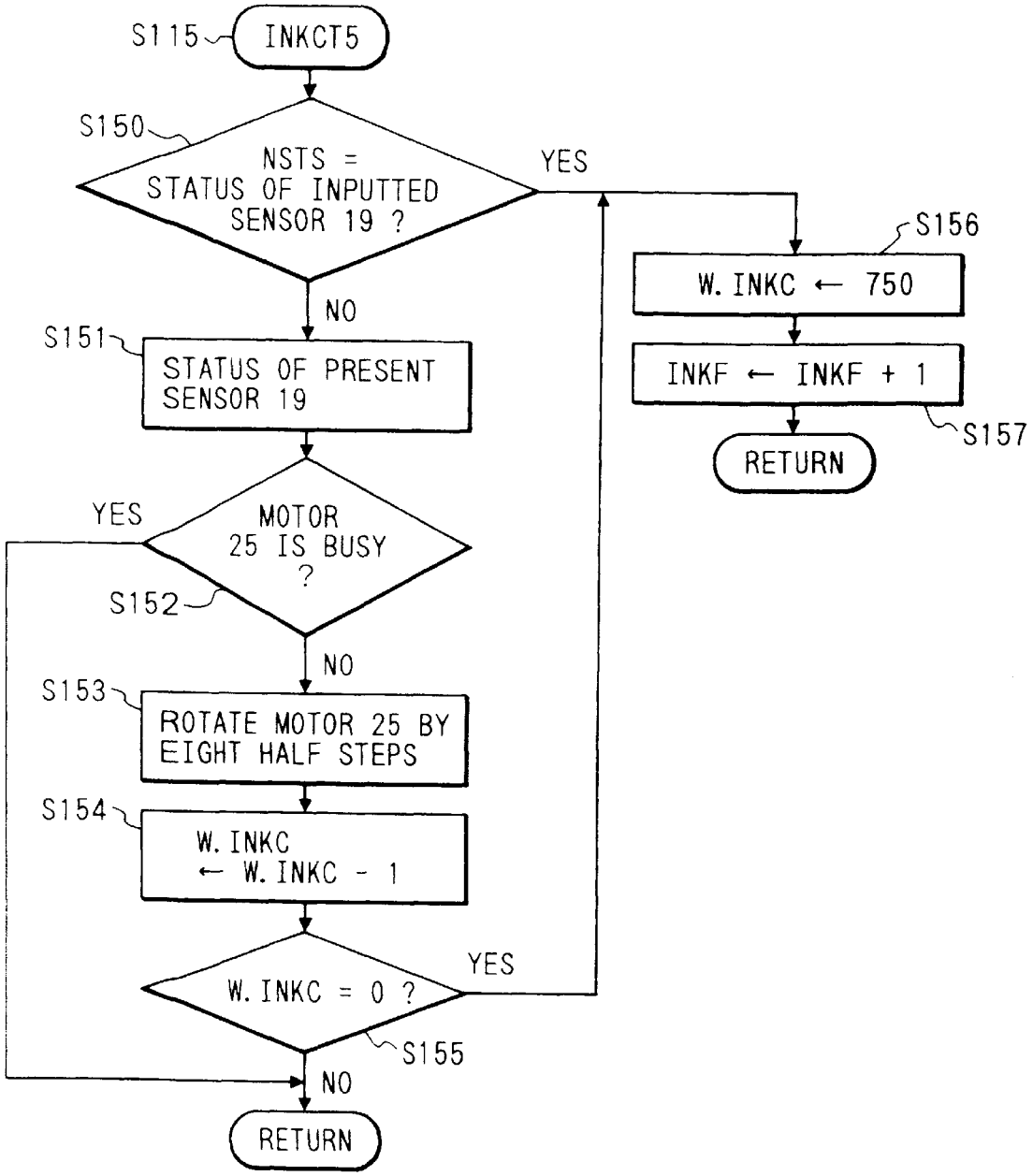

If the flag INKF is "5" at step S114, the operation proceeds to step S150, as shown in FIG. 17, where a comparison is made between a value stored in the NSTS of the RAM 115 and a current value of the sensor 19. If they are equal, the operation proceeds to step S156, where the flag W.INKC is set at 750 (7.5 sec.). And at step S157, the flag INKF is incremented by +1, resulting in "6".

On the other hand, if the current status of the sensor 19 and the value of NSTS are not coincident, the operation proceeds to step S151, where the current value of the sensor 19 is stored in the NSTS. And if the ink sheet conveying motor 25 is confirmed again not to be busy at step S152, the ink sheet conveying motor 25 is rotated by eight half steps at 400 pps at step S153. And at step S154, the flag W.INKC is decremented by 1, and if the value of the flag W.INKC is not "0" at step S155, the operation returns to the original routine. If the flag W.INKC is "0", the operation proceeds to step S156, where the flag W.INKC is set at 750 (7.5 sec.), resulting in "6", and the operation returns to the original routine.

Figure 18:
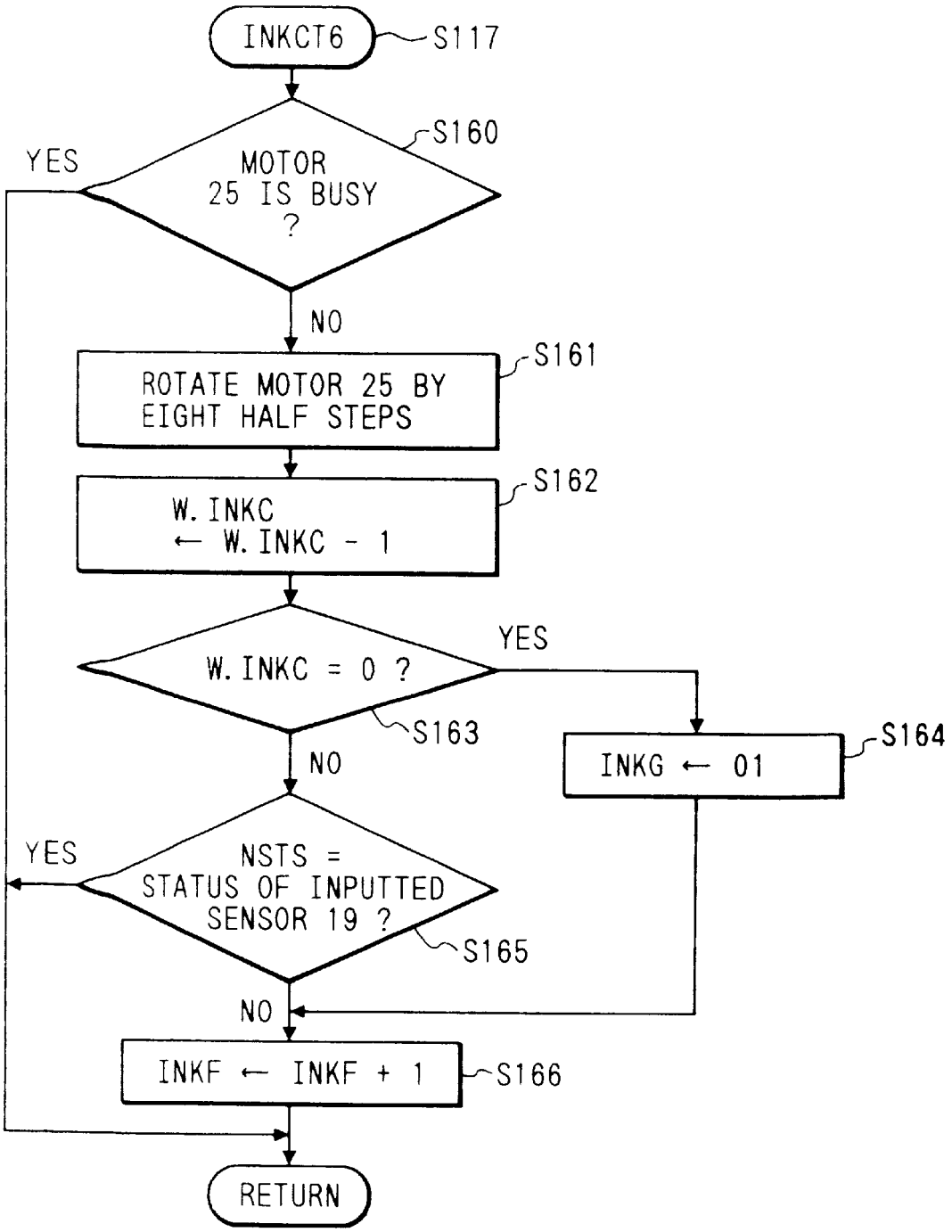

If the flag INKF is "6"at step S116 in FIG. 13, the operation proceeds to step S160, as shown in FIG. 18. And if the ink sheet conveying motor 25 is confirmed not to be busy, the ink sheet conveying motor 25 is rotated by eight half steps at step S161. Then proceeding to step S162, the flag W.INKC is decremented by 1, and at step S163, a determination is made whether or not the flag W.INKC is "0", i.e., 7.5 seconds have passed. Thus, if the slackness removal of ink sheet has not been completed after the passage of 7.5 seconds, the operation proceeds to step S164, where the flag INKG is set at "1". Then proceeding to step S166, the flag INKF is incremented by +1, resulting in "7".

On the other hand, if the flag W.INKC is not "0" (or 7.5 seconds have not passed) at step S163, the operation proceeds to step S165, where a comparison is made between a value of the NSTS in the RAM 115 and a current status of the sensor 19. If they are unequal, the operation proceeds to step S166, the flag INKF is incremented by +1, resulting in "7", whereby the termination of removing the slackness of ink sheet is determined.

Figure 19:
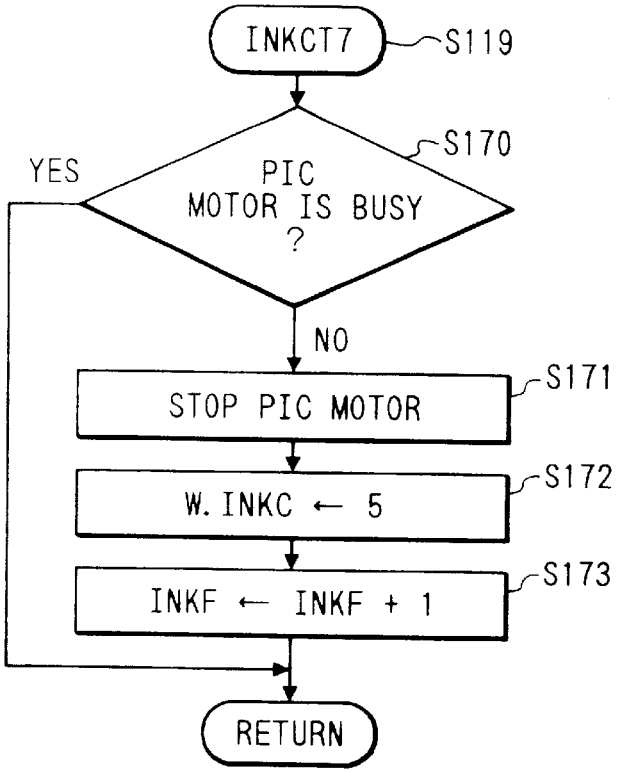

Furthermore, if the flag INKF is "7" at step S117, the operation proceeds to step S170, as shown in FIG. 19, for confirming that the PIC motor is not busy. After confirmation, the rotation of the PIC motor is stopped (step S171). And proceeding to step S172, the W.INKC is set at "5", and then the flag INKF is incremented by +1, resulting in "8".

Figure 20:
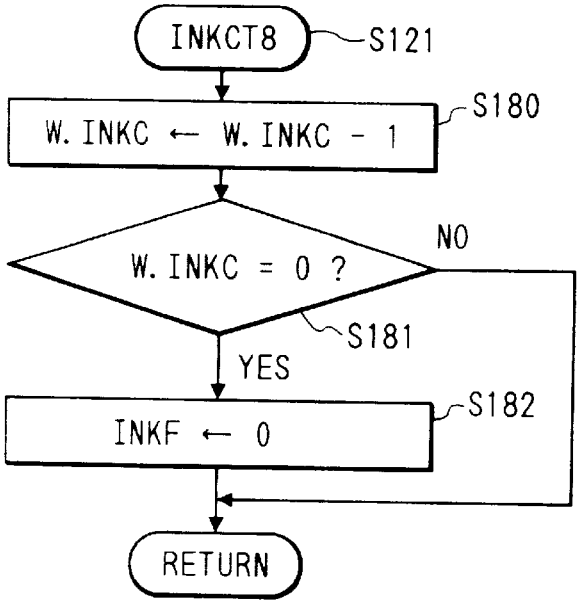

Finally, if the flag INKF is "8", the operation proceeds to step S180, as shown in FIG. 20, where the flag W.INKC is decremented by 1. And if the value of W.INKC is "0" at step S181, the flag INKF is set at "0" at step S812. That is, a wait is made for 50 ms. Note that if the flag INKF is a value other than "0" to "8", the operation proceeds to the original routine in the flowchart as shown in FIG. 13.

FIGS. 21 to 23 are flowcharts representing the preamble transmission in the prior sequence and the slackness removal of ink sheet.

First, at step S190, RS is turned on for a V21 modem, and at step S191, the operation waits for CS to be turned on. And a value corresponding to 1 second is set to TIMER in the RAM 5. The value of TIMER is decremented by 1 at predetermined periods by an interrupt routine, not shown. Thereby, the time of sending the preamble can be controlled by the TIMER. Then, a determination is made whether or not the memory is received at step S193, in which if the memory is received, the operation proceeds to step S206, the operation waits for the value of TIMER to be zero as the slackness of ink sheet is not removed, and then returns to the original routine.

Since the slackness of ink sheet is not removed when the memory is received, the ink sheet is not conveyed wastefully.

On the other hand, if the memory is not received at step S193, the operation proceeds to step S194, where a determination is made whether or not a CFR signal (a signal to be sent out when the reception preparation has been completed) was transmitted once before. The operation proceeds to step S208 if it has been transmitted, or otherwise to step S195.

At step S195, a determination is made whether or not the mode is an ECM (error correcting mode) in which the reception is recovered by sending it again when a reception error occurs. And for the ECM, when an MCF signal (reception acknowledge signal) is transmitted for a signal other than PPS-EOP, EOR-EOP (a final page indication signal), and PPS-NULL, DOR-NULL (a physical page non-breakpoint signal) at step S196 to S203, or if RR (receive ready) is received, when the signal received before receiving the RR signal is other than PPS-NULL or EOR-NULL, the operation proceeds to step S207, where the slackness of ink sheet is removed. If any other signal is transmitted, the operation proceeds to step S206 to wait for the value of TIMER to be "0", i.e., for the passage of 1 second, and returns to the original routine.

When the reception acknowledge signal is transmitted for a page non-breakpoint signal, the slackness of ink sheet is not removed. Therefore, it is possible to prevent the occurrence of white streaks with the recording unit, which may be caused by fused portion of the ink to be conveyed without being transferred, because at a newly heated portion of the ink sheet, less heat accumulates and the ink transfer can not be successfully made.

Also, when the reception acknowledge signal is transmitted for a final page indication signal, the slackness of ink sheet is not removed. This is because if it takes a long time prior to recording the next page, irrespective of removing the slackness of ink sheet, the slackness of the ink sheet may occur during such a time. Hence, the slackness of the ink sheet should be removed immediately before recording the next page.

On the other hand, if the mode is not ECM at step S195, the operation proceeds to step S204, where the MCF signal is transmitted, and at step S205, if it is performed except for the EOP signal (a final page indication signal), the operation proceeds to step S207 to remove the slackness the of ink sheet. And if any other signal is transmitted, the operation proceeds to step S206 to wait for the value of TIMER to be "0", i.e., the passage of 1 second, and returns to the original routine.

The processings following step S207 will be now explained. At step S207, a determination is made whether or not the mode is the G3 constant speed reception, in which if the answer is yes, the operation proceeds to step S206, in which the transmission time of the preamble is 1 second as the slackness of ink sheet is removed while 256 lines of signals for the next page are received.

On the other hand, if the mode is not the G3 constant speed reception at step S207, the operation proceeds to step S208, where if both the flags INKF and INKG are "0", the operation proceeds to step S210. At step S210, the flag NVALSE is set at "1", because the slackness removal of the ink sheet has been successfully terminated due to an interrupt after the termination of cutting the recording sheet 15 with a cutter 15, and then the operation proceeds to step S206 to send the preamble for 1 second.

If at least one of the flag INKF or F.INKNG is "1" at steps S208 and S209, the operation proceeds to step S211, where the PIC motor is started. Next, at step S212, a predetermined time (e.g., 5 seconds) is set to TIMER, and at step S213, a current status of the sensor 19 is stored into the NSTS of the RAM 115. And if the ink sheet conveying motor 25 is not busy, the operation proceeds to step S215, where the ink sheet conveying motor 25 is rotated by eight half steps at 1200pps. If a determination is made that a value stored in the NSTS within a predetermined time (5 seconds) set at step S212 is different from a current value of the sensor 19, that is, the slackness removal of the ink sheet has been terminated, the operation proceeds from step S216 to S217. And the flag NVALSE is set at "1" (step S217), and the PIC motor is stopped (step S218). And proceeding to step S219, if the flag R.PAMBLSE is less than 1 second, the flag AX of the RAM 115 is set at "0" at step S220 to transmit the preamble for one second. If it exceeds one second, the operation proceeds to step S221, where (R.PAMBLSE—one second) is set to the flag AX, for stopping the transmission of the preamble.

At step S224, if the value of NSTS is not coincident with the current value of the sensor 19, even after five seconds, the operation proceeds to step S225, where the flag NVALSE is set at "0". And proceeding to step S226, the PIC motor is stopped.

Figure 24:
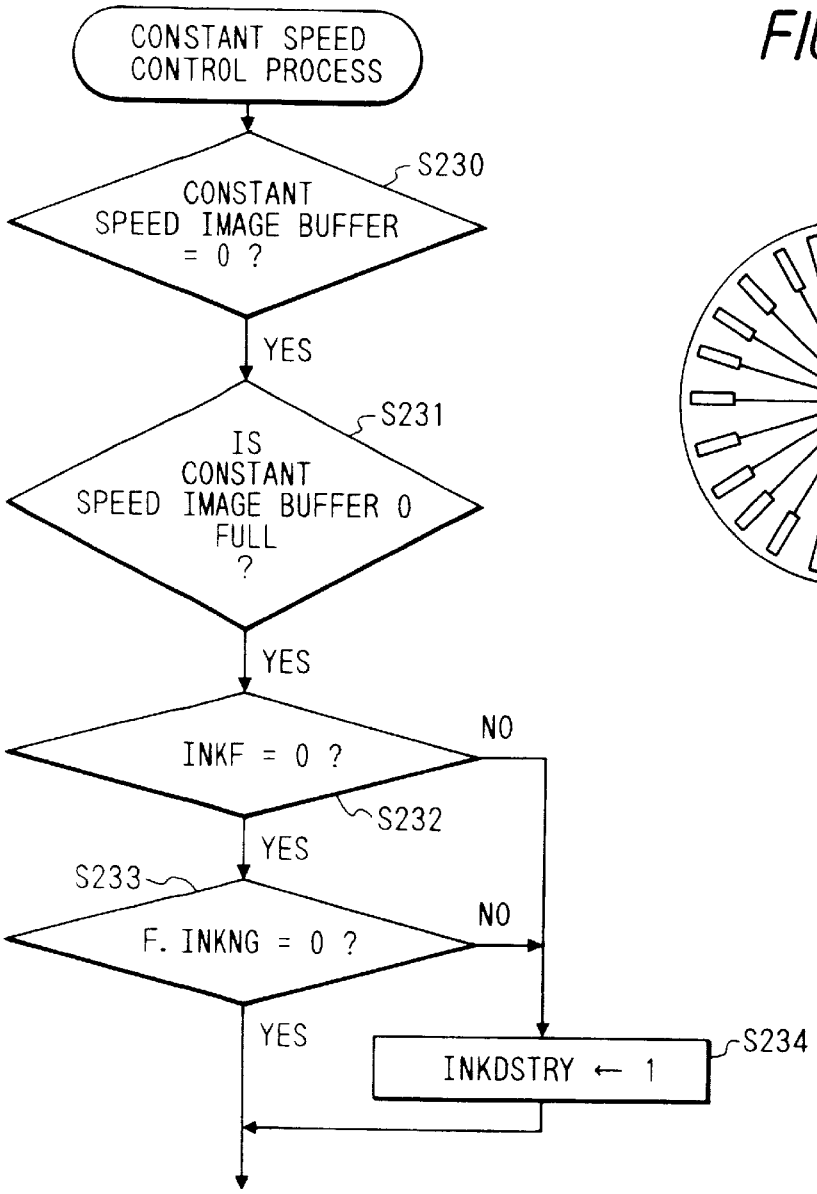
FIG. 24 is a flowchart showing a constant speed control process.

FIG. 24 is a flowchart showing an interrupt process in recording at constant speed, and particularly a control process in which the slackness removal of ink sheet has not been terminated when the constant speed image buffer 0 is full.

The outline of this processing will be described. In the G3 constant speed reception, the recording of image is started after 256 lines of data have been completed. Here, the decoding for receiving data is carried out by a main software routine, and the recording operation is performed by a constant speed control process routine represented by a flowchart as shown in FIG. 24, which is called for every 10 ms. Here, a determination is made whether or not the slackness removal of ink sheet has been terminated, when raw data is stored into the constant speed buffer 0 in the main routine. When the slackness removal of ink sheet has been terminated, that is, the flag INKF or INKG is "1", the flag INKDSTRY is set at 1 to notify the main routine that the slackness removal of ink sheet has failed. Thereby, the main routine detects the status of the flag and displays a message of checking the cartridge.

In FIG. 24, two constant speed image buffers 0 and 1 are considered, and at step S230, the image data is stored into the constant speed buffer, beginning with the buffer 0. And if 256 lines of data are stored into the constant speed image buffer 0 by the main routine at step S231, the constant speed recording is started. If the constant speed image buffer is full, a determination is made whether or not the slackness removal of the ink sheet after the cut operation is terminated. That is, if the slackness removal of the ink sheet has been terminated (the flag INKF is "0" and the flag F.INKNG is "0") at steps S232 and S233, the operation transfers to the recording operation. If the slackness removal of the ink sheet has not been terminated (the flag INKF is "1" or the flag INKG is "1"), the operation proceeds to step S234, where the flag INKDSTRY of the RAM 115 is set at "1", and notifies the main routine that the slackness removal of the ink sheet has failed. Thereby, a message of "Check cartridge" is displayed by the main routine.

Finally, the slackness removal of the ink sheet as above described will be comprehensively set forth.

(1) When ECM is received in the G3 (not constant speed)

When the automatic reception or manual reception is selected, the slackness removal of the ink sheet is practiced in the interrupt routine (400pps). The slackness removal of the ink sheet in the interrupt routine is started with the setting of INKF=2 at step S42 in FIG. 8, and carried out in the following procedure in accordance with the flowcharts as shown in FIGS. 13 to 20.

① Every time the ink sheet conveying motor 25 is rotated by eight half steps at 400 pps (step S161), an output value of the sensor 19 stored in the NSTS and a current status of the sensor 19 are checked, in order to confirm that the value of NSTS is the same as that of the sensor 19 until the ink sheet conveying motor 25 is rotated by 10 times.

② Every time the ink sheet conveying motor 25 is rotated by eight half steps, the value of NSTS and that of the sensor 19 are checked, and the flag INKF is set at "0" by determining that the slackness removal of the ink sheet has been terminated if the value of NSTS and that of the sensor 19 become unequal within 7.5 seconds. On the other hand, if the value of NSTS and the output value of the sensor 19 are equal even after 7.5 seconds, the flag INKF is set at "0" and the flag INKG is set at "1" (step S164). And the conveyance of the ink sheet is stopped.

Also, when one page of recording has been terminated, the flag INKF is set at "1" at step S54, prior to the cut operation of the recording sheet 11. And after the cut operation, the flag INKF is set at "2" (step S53), and the slackness removal of the ink sheet is started with the interrupt routine. Thereinafter, the operation is the same as previously described.

(2) When the preamble signal for CFR signal, MCF signal (except that for EOP signal, PPS-EOP signal, EOR-EOP signal) is transmitted.

When the value of NSTS and a current value of the sensor 16 are not equal (more specifically INKF=0 and INKG=0) in the slackness removal of the ink sheet with the interrupt routine after the cut operation, in transmitting the preamble, a preamble signal is transmitted for one second without conveying the ink sheet 14. And at step S210, the flag NVALSE is set at "1".

When the value of NSTS and a current value of the sensor 16 are equal (more specifically INKF=1or INKG=1) in the slackness removal of the ink sheet with the interrupt routine after the cut operation, ① Every time the ink sheet conveying motor 25 is rotated by eight half steps at 1200 pps, the value of NSTS and the value of the sensor 19 are checked, in which if the status of the sensor 19 is changed within a predetermined time (e.g., five seconds), the slackness removal of the ink sheet is determined after the preamble is sent out for at least one second, and the flag NVALSE is set at "1" (step S217).

② If the status of the sensor 19 is not changed within this predetermined time, the slackness removal failure of ink sheet is determined, and the flag NVALSE is set at "0" at step S225.

(3) Slackness removal prior to recording of one page.

When the slackness removal of the ink sheet is excellent (NVALSE=1) (step S65), the processing of rotating the ink sheet conveying motor 25 by eight half steps at 400pps is repeated by 24 times (steps S69 to S71) so as to remove the slackness of ink sheet.

When the slackness removal of the ink sheet is false (NVALSE=0), the operation proceeds to step S66, where a cartridge check error is set.

Note that when one communication cut is set, the slackness of ink sheet is also removed prior to recording of one page.

(4) At the G3 reception (constant speed)

For the G3 (not constant speed), ECM reception, the following alterations are made.

① The preamble signal for the MCF signal (except that for EOP signal, PPS-EOP signal and EOR-EOP signal) is set to be one second, in which the slackness of ink sheet is not removed.

② When the recording of image signal is started, the slackness removal of ink sheet (24 times of the rotation of eight half steps) is not practiced.

③ When the slackness removal of ink sheet is not terminated at the time the constant speed buffer is full in the interrupt routine, the "check cartridge" is indicated.

While in the above example, the slackness removal of ink sheet is not practiced at the intercepting, it is also possible not to remove the slackness of ink sheet at the forced memory reception or confidential reception.

In the above example, the slackness of ink sheet is not removed when the recording is impossible with recording means, but such a recording impossible time further includes an instance where the recording sheet is used up. If the slackness of the ink sheet is removed in a recording sheet exhausted condition, the ink sheet is placed in direct contact with the platen roller, damaging the ink sheet, but this problem can be avoided according to this invention.

As above described, according to the present invention, there is the effect of preventing the occurrence of white streaks in a recorded image, because the slackness removal of ink sheet is not practiced unless it is necessary, for example, when the recording operation is impossible or the memory is received.

EXAMPLE 2

Example 2will be described below. Note that as the constitution of a recording unit 102 is the same as in the example 1, the explanation is omitted. In the example 2, an embodiment in which the slackness of ink sheet is removed by slackness removing means, particularly upon detection of the event that a cover of apparatus is turned from an open state to a closed state, the ink sheet cartridge is exchanged, or the power is turned on.

Figure 25:
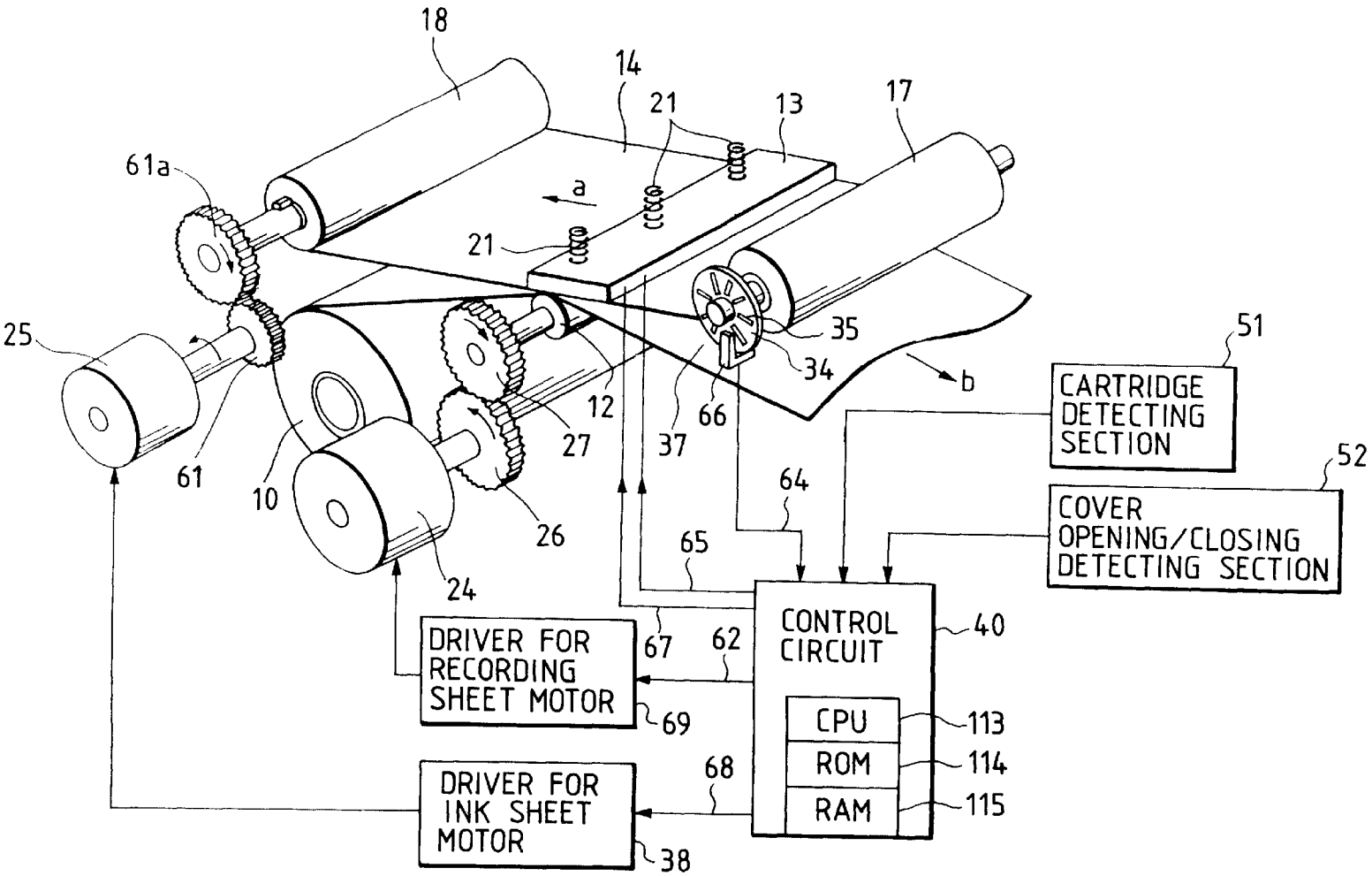
FIG. 25 is a view showing an appearance of a recording unit in a facsimile terminal equipment of an example 2, and the electrical connections with a control circuit thereof.

FIG. 25 is a view illustrating the detail of a portion which performs the recording with a thermal head in a facsimile terminal equipment of this example.

In FIG. 25, 25 is an ink sheet conveying motor for rotating an ink sheet take-up roll 18 to take up an ink sheet 14 in the direction of arrow a. 24 is a recording sheet conveying motor for rotating a platen roller 12 to convey a recording sheet 11 in the direction of arrow b. 61, 61*a* are ink sheet conveying transmission gears for transmitting a driving force of the ink sheet conveying motor 25 to the ink sheet take-up roll 18, and 26, 27 are platen driving transmission gears for transmitting a rotational driving force of the recording sheet conveying motor 24 to the platen roller 12. With the above constitution, assuming that the conveyance speed of the recording sheet 11 is $V_P$, and the conveyance speed of the ink sheet is $V_I$, the ink sheet 14 and the recording sheet 11 are conveyed accordingly to the relationship $V_P=-nV_I$ (n>1). Here, a sign—indicates that the recording sheet 11 and the ink sheet 14 are conveyed in mutually opposite directions. Note that the value of n can be arbitrarily changed by the gear ratio of gears 61, 61*a* in the ink sheet driving transmission system, and the gear ratio of gears 26, 27 in the recording sheet transmission mechanism. It can be also set at will by changing the driving frequency for the ink sheet conveying motor 25 and the recording sheet conveying motor 24, or changing the rotation angle per step for the phase exciting signal.

Figure 26:
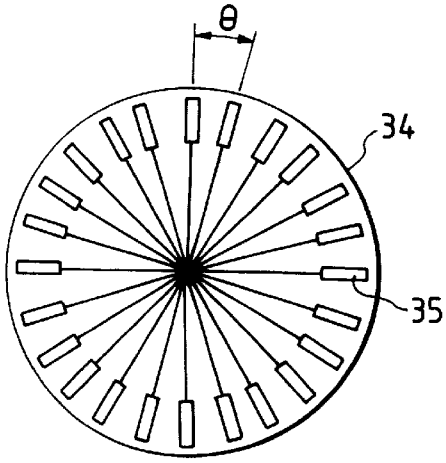
FIG. 26 is a front view of a disk (circular plate) of an encoder in the example 2.

21 is a presser spring for pressing the thermal head 13 against the platen roller 12. 37 is an encoder, 34 is a disk, 35 is slits provided radially on the disk 34 at equal spacings, and 66 is a photo interrupter for detecting the rotation of the disk 34 by sensing the light passing through the slit 35. FIG. 26 is an enlarged view of the disk 34 in which a plurality of slits are provided at predetermined angles of θ.

38 is a driver for driving the ink sheet conveying motor 25, which is rotated by switching the exciting phase of the ink sheet conveying motor 25, with an instruction from a control circuit 40. 69 is a driver for driving the recording sheet conveying motor 24, which is rotated by switching the exciting phase of the recording sheet conveying motor 24, with an instruction from the same control circuit 40.

The control circuit 40 comprises a CPU 113 such as microprocessor, a ROM 114 for storing the control programs for the CPU 113 or various data, and a RAM 115 useful as a work area for the CPU 113. 64 is a timing signal line from the photo interrupter 66, 65 is a signal line for outputting the record data to the thermal head 13, and 67 is a control signal line including a clock signal in synchronism with the record data, a latch signal, and a strobe signal. 62, 68 are motor driving signals for driving the corresponding motors, respectively.

51 is a cartridge detecting section composed of micro switches for detecting the presence or absence of an ink sheet cartridge, in which if the cartridge has been set, a high level signal is output to the control unit 40. 52 is a cover opening/closing detecting section for detecting the opening or closing of a cover the apparatus, composed of micro switches, in which if the apparatus cover has been closed, a high level signal is output to the control unit 40.

The operation of the facsimile terminal equipment in this example with the above constitution will be described briefly. If the recording cover is turned from an open state to a closed state, the slackness of ink sheet is removed by rotating the ink sheet take-up roll 18. Upon detecting that the ink sheet cartridge is present, or that the power is turned on, the slackness of ink sheet is removed. Thus, the recording is performed with the value of n being almost constant. The operation of removing the slackness of ink sheet will be specifically described. The ink sheet motor 25 is rotated until the status of an encoder 37 provided on a rotation shaft of the ink sheet supply roll 17 is changed. In order to keep the value of n substantially constant, it is necessary to obtain the number of conveying steps for the ink sheet conveying motor 25 required to rotate the encoder 37 by a predetermined angle, and a take-up diameter of the ink sheet take-up roll 18 based on the number of conveying steps. The conveyance speed of the ink sheet conveying motor 25 is thereby determined. For example, at the recording in a super fine mode, the recording sheet 11 is conveyed at 400 pps, while the ink sheet 11 is conveyed at 800 pps or 1200 pps. This can be accomplished by switching the conveyance speed of the ink sheet 11 to 800 pps or 1200 pps, in accordance with the diameter of the ink sheet take-up roll 18. When the reception or copying operation is performed, it is necessary to always obtain the number of driving steps for the ink sheet conveying motor 25 required to rotate the encoder 37 provided on the ink sheet supply roll 17 by a predetermined angle, and update the conveyance speed of the ink sheet 14 in accordance with the number of driving steps.

Figure 27:
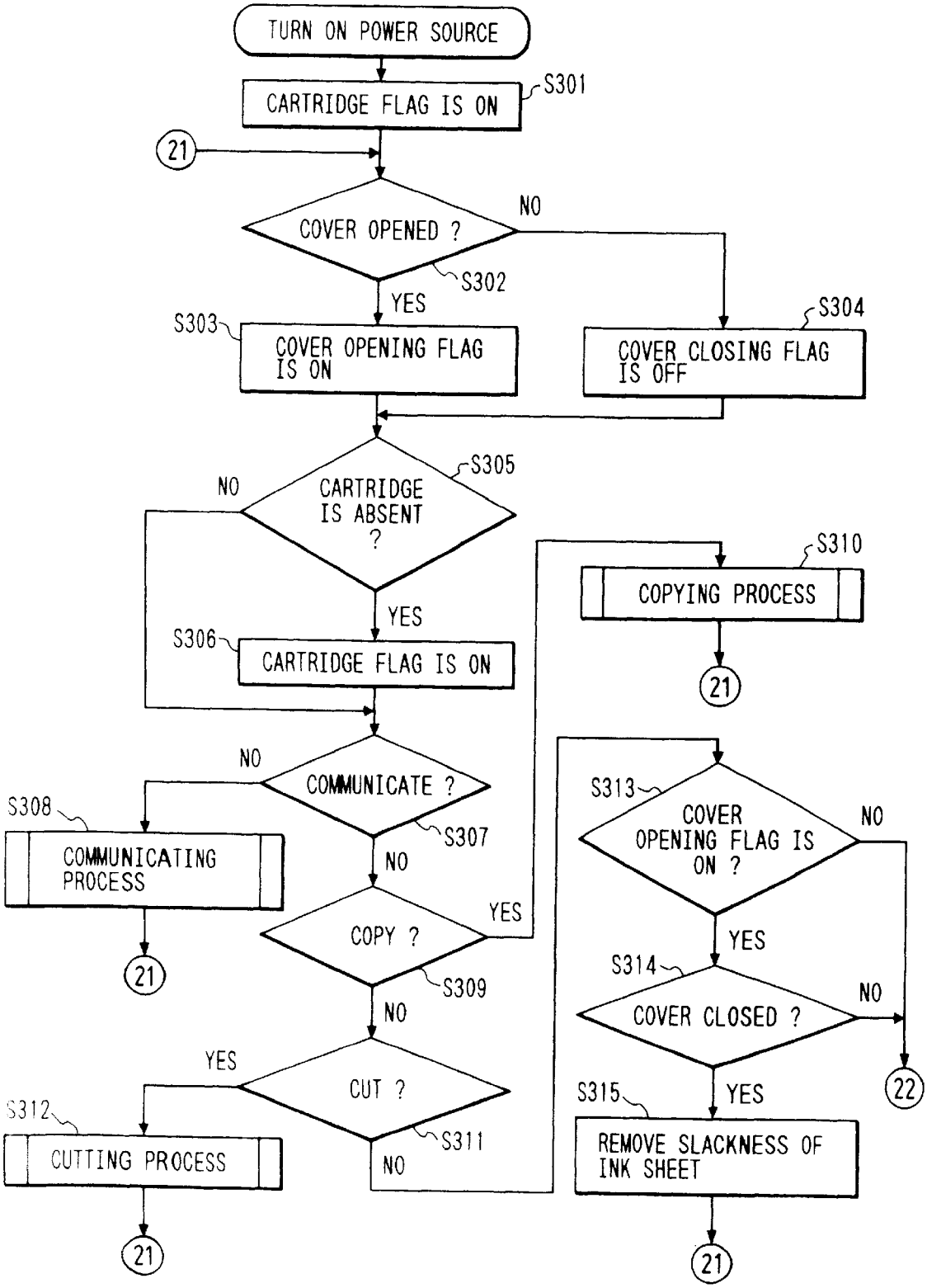
FIGS. 27 and 28 are flowcharts showing removal of ink sheet slack in the facsimile terminal equipment of the example 2.
Figure 28:
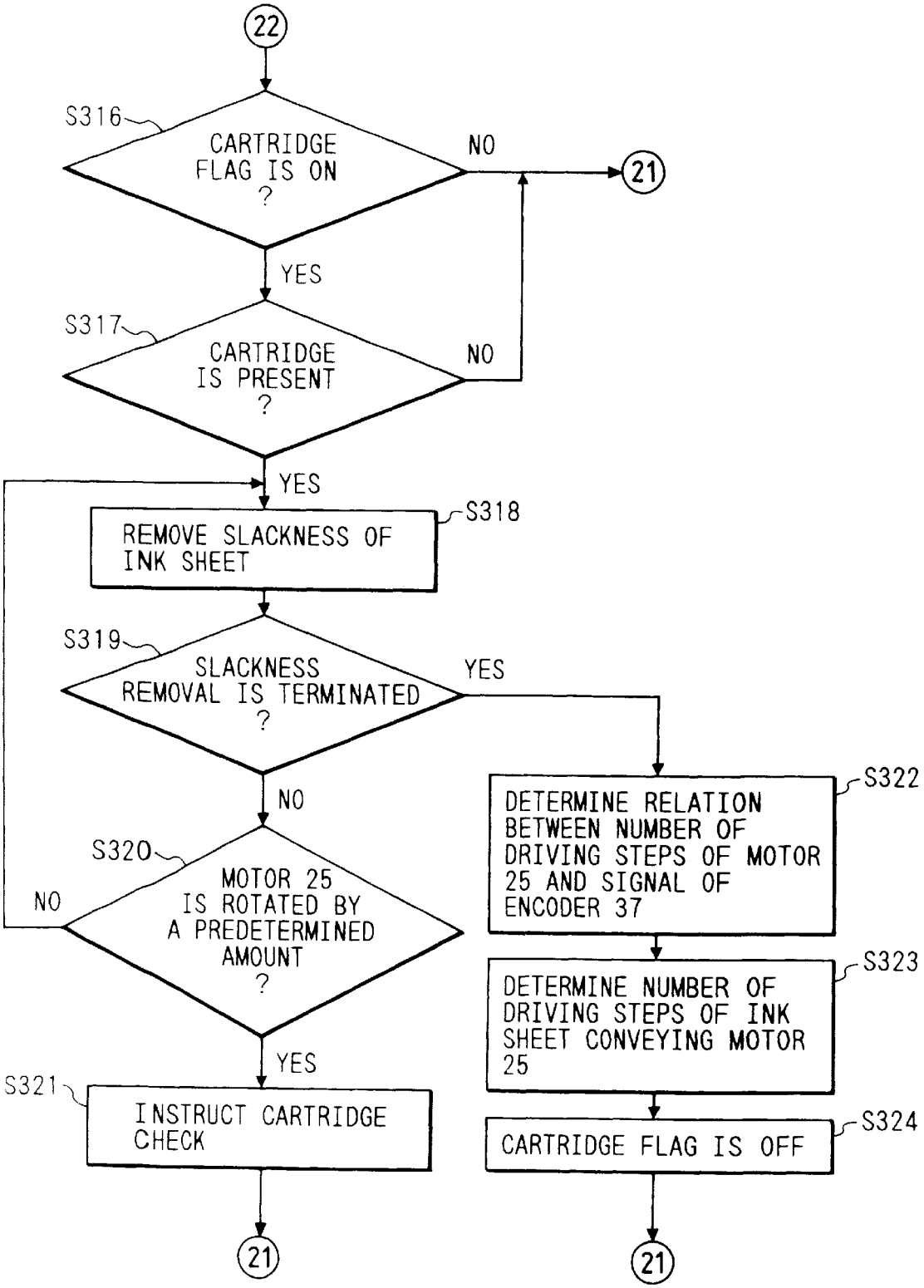

Next, the operation of the facsimile terminal equipment with the above constitution will be described with reference to flowcharts as shown in FIGS. 27 and 28. The control program for executing this flowchart is stored in the ROM 114.

This process is started upon turning on the power. First, a cartridge flag provided on the RAM 115 is turned on at step S301. Because the ink sheet may be possibly exchanged while the power supply of the apparatus is off, the cartridge flag indicating that the cartridge is exchanged is turned on. At step S302, a determination is made whether or not the cover of apparatus is open, based on a signal from the cover opening/closing detecting section 52, in which if it is open, a cover opening flag of the RAM 115 is turned on at step S303, while if it is closed, a cover closing flag is turned off at step S304. Then at step S305, a determination is made whether or not the ink sheet cartridge is present, based on a signal from the cartridge detecting section 51, in which if it is absent, the operation proceeds to step S306, where the cartridge flag is turned on.

Next, proceeding to step S307, a determination is made whether or not the transmission or reception process of facsimile is indicated, in which if the answer is yes, the operation proceeds to step S308, where the communication process for facsimile signals is performed, and in the reception, a facsimile image received from the recording unit 102 is decoded and printed onto the recording sheet 11. If the copying operation is indicated at step S309, the operation proceeds to step S310, where an original image is read by the reading unit 100 and printed onto the recording sheet 11 in the recording unit 102. If the cut operation is indicated at step S311, the recording sheet 11 is conveyed by a predetermined amount and cut off in a units of pages with a cutter 15 at step S312. These processings are well known, and not described in detail.

Next, proceeding to step S313, a determination is made whether or not a cover opening flag of the apparatus is on, in which if it is on, the operation proceeds to step S314 to determine whether or not the cover is closed in practice, based on a signal from the cover opening/closing detecting section 52. If the cover opening flag is not on, or the cover is opened, the operation proceeds to step S316, while if the cover opening flag is on, and the cover is closed, the operation proceeds to step S315, where the ink sheet conveying motor 25 is rotated by a predetermined amount until the signal from the photo interrupter 66 of the encoder 37 is changed by determining that the ink sheet cartridge has been loaded immediately before. Thus, upon detecting that the ink sheet supply roll 17 is rotated with the rotation of the ink sheet take-up roll 18, the operation returns to step S302, because the slackness of ink sheet 14 has been removed.

At step S316, a determination is made whether or not the cartridge flag is on, in which if it is on, the operation proceeds to step S317 to determine whether or not the ink sheet cartridge is loaded in practice, based on the signal from the cartridge detecting section 51. If the cartridge flag is off or the cartridge is not loaded, the operation proceeds to step S302, while if the cartridge flag is on and the cartridge is loaded, the operation proceeds to step S318 by determining that the power is turned from off to on, or the ink sheet cartridge has been exchanged immediately before, where the slackness of ink sheet 14 is removed in the same way as at previous step S315.

Then proceeding to step S319, a determination is made whether or not the slackness removal of ink sheet is terminated. If it is not terminated, the operation proceeds to step S320 to determine whether or not the ink sheet conveying motor 25 is rotated by a predetermined amount or more. If the motor 25 is rotated by a predetermined amount or more at step S320 but the rotation of the ink sheet supply roll 17 is not detected by the encoder 37, the operation proceeds to step S321, where a message of checking the cartridge is displayed on the indication unit 104, because it is apprehended that the ink sheet 14 may be disconnected, for example. Note that the process of detecting the disconnection of ink sheet 14 based on the rotation amount of the ink sheet conveying motor 25 may be also carried out at step S315 as previously mentioned.

If the slackness removal of ink sheet 14 is terminated at step S319, the operation proceeds to step S322 to obtain the number of driving steps of the motor 25 for one slit by rotating the ink sheet conveying motor 25 until a detection signal of the slit 35 from the photo interrupter 66 is changed. An average value should be obtained from a plurality of measurements. Then proceeding to step S323, the take-up diameter of the ink sheet take-up roll 18 is obtained based on the number of driving steps for the ink sheet conveying motor 25 for one slit. This can be accomplished by storing the number of driving steps for one slit corresponding to each take-up diameter as a table in the ROM 114, and determining it with reference to the table. Thus, if the diameter of the take-up roll 18 is determined, the conveyance speed of the ink sheet conveying motor 25 is determined based on that value. That is, the number of driving steps in recording one line is determined. For example, when recording at the super fine mode, the recording sheet 11 is conveyed at 400 pps, and the ink sheet 14 is conveyed at 800 pps or 1200 pps in accordance with its take-up diameter. And the operation proceeds to step S324, where cartridge flag is turned off, and returns to step S302.

Note that the slackness removal of ink sheet may be made more properly in such a way as to detect the slit 35 with the photo interrupter 66, and then convey the ink sheet 14 by a predetermined amount.

As above described, according to this example, the multi print recording is enabled with the n value being substantially constant from the first page after the exchange of the ink sheet cartridge. Therefore, the image quality of recording for the first page can be assured.

The conveying speeds for the recording sheet 11 and the ink sheet 14 are determined by detecting the rotation amount of the ink sheet supply roll 17 relative to that of the ink sheet take-up roll 18 so as to make the n value substantially constant for the safety when the power is turned on, although the detection of the ink sheet cartridge is not allowed at the power off state of the apparatus.

Since the slackness removal of ink sheet is practiced when the recording sheet 11 is exchanged, it is unnecessary to remove the slackness of ink sheet in the first recording operation after the recording sheet 11 is exchanged. Thereby, when the first recording operation after the exchange of the recording sheet 11 is a reception operation, it is possible to prevent the occurrence of a communication error which may occur if it takes much time remove the slackness of ink sheet.

As above described, according to the present invention, there is the effect that the recording quality after the exchange of the cartridge or recording sheet can be prevented from degrading, because the conveyance length of the ink sheet is made substantially constant relative to that of the recording sheet, in recording, from the first page after the power is turned on, or the ink sheet cartridge or recording sheet is exchanged.

EXAMPLE 3

Example 3 will be described below. Note that the constitution of a recording unit 102 is the same as in the example 1, and the explanation will be omitted. In the example 3, an embodiment in which if detecting means does not detect that the ink sheet has been conveyed particularly when ink sheet conveying means is driven by a predetermined amount, the disconnection of the ink sheet is determined will be described.

FIG. 25 is a view showing an appearance of a recording unit which performs the recording in a facsimile terminal equipment of the example 3, and the electrical connections with a control circuit.

In FIG. 25, 25 is an ink sheet conveying motor for rotating an ink sheet take-up roll 18 to take up an ink sheet 14 in the direction of arrow a. 24 is a recording sheet conveying motor for rotating a platen roller 12 to convey a recording sheet 11 in the direction of arrow b. 61, 61*a* are ink sheet conveying transmission gears for transmitting a driving force of the ink sheet conveying motor 25 to the ink sheet take-up roll 18, and 26, 27 are platen driving transmission gears for transmitting a rotational driving force of the recording sheet conveying motor 24 to the platen roller 12. 21 is a presser spring for pressing a thermal head 13 against the platen roller 12. 37 is an encoder, 34 is a disk, 35 is slits provided radially on the disk 34 at equal spacings, and 66 is a photo interrupter for detecting the rotation of the disk 34 by sensing the light passing through the slit 35.

38 is a driver for driving the ink sheet conveying motor 25, which is rotated by switching the exciting phase of the ink sheet conveying motor 25, with an instruction from the control circuit 40. 69 is a driver for driving the recording sheet conveying motor 24, which is rotated by switching the exciting phase of the recording sheet conveying motor 24, with an instruction from the same control circuit 40.

The control circuit 40 comprises a CPU 113 such as a microprocessor, a ROM 114 for storing the control programs for the CPU 113 or various data, and a RAM 115 useful as a work area for the CPU 113. 64 is a timing signal line from the photo interrupter 66, 65 is a signal line for outputting the record data to the thermal head 13, and 67 is a control signal line including a clock signal in synchronism with the record data, a latch signal, and a strobe signal. 62, 68 are motor driving signals for driving the corresponding motors, respectively.

The operation of the facsimile terminal equipment with the above constitution will be described with reference to a flowchart of FIG. 30. The control program for executing this flowchart is stored in the ROM 114.

If the first one line of record data is prepared by receiving a facsimile signal, the slackness removal of ink sheet is carried out at step S401. This process will be described in detail with reference to a flowchart of FIG. 31. Next, proceeding to step S402, one line of record data is serially transferred via the signal line 65 to a shift register (not shown) of the thermal head 13. If one line of record data is stored in the shift register, the operation proceeds to step S403, where the line data is transferred to a latch circuit (not shown) within the thermal head 3 with a latch signal. Then at step S404, the ink sheet conveying motor 25 is driven for rotation by the ink sheet conveying motor driver 38 to convey the ink sheet 14. Then proceeding to step S405, the recording sheet conveying motor 24 is driven by the recording sheet conveying motor driver 69 to convey the recording sheet 11. Here, the relation between the conveyance speed $V_I$ of the ink sheet 14 and that $V_p$ of the recording sheet 11 is $V_p=-nV_I$ (n>1). Here, a sign—indicates that the recording sheet 11 and the ink sheet 14 are conveyed in mutually opposite directions.

Figure 29:
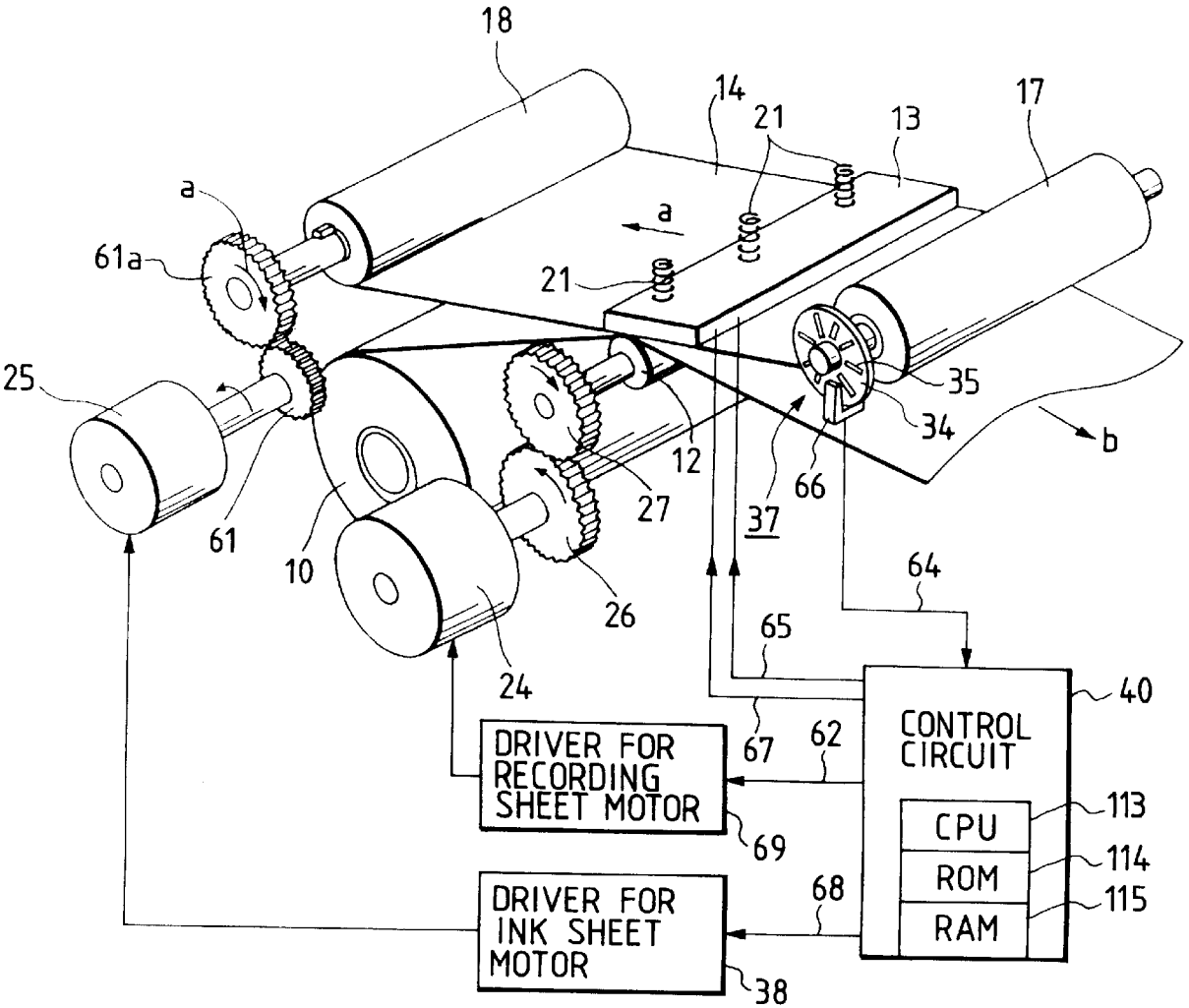
FIG. 29 is a view showing an appearance of a recording unit in a facsimile terminal equipment of an example 3, and the electrical connections with a control circuit thereof.

Note that the value of n can be arbitrarily set by appropriately designing the relation between the reduction gear ratio of ink sheet driving transmission gears 61, 61a in the gear transmission system, and the reduction gear ratio of platen driving transmission gears 26, 27 in the gear transmission system. It can be also set at will by changing the frequency ratio of the phase exciting signals for the ink sheet motor driver 38 and the recording sheet motor driver 69. Also, it can be arbitrarily changed by suitable selecting arbitrarily the step feed angles for a phase exciting signal for the ink sheet conveying motor 25 and the recording sheet conveying motor 24. Thereby, the recording sheet 11 is conveyed by one line in the direction of arrow b in FIG. 29 in recording, while the ink sheet 14 is conveyed by 1/n line in the direction of arrow a.

In this way, after the conveyance of the ink sheet 14 and the recording sheet 11 is started by sending the phase exciting signal to each motor 24, 25, one line of recording is performed in a unit of block of the thermal head 13 by outputting a strobe signal via the signal line 67. At step S407, a determination is made whether or not the recording for one line of data is terminated, in which if it is not terminated, the operation proceeds to step S408, where the next line data if any prepared is transferred to the thermal head 13, and returns to step S406.

If the recording for one line of data is terminated at step S407, the operation proceeds to step S409 to determine whether or not one page of recording is terminated. If one page of recording is not terminated, the operation proceeds to step S410, where the next line data is transferred to the thermal head 13, if the next line data is present. In this way, if the transfer for the next line data is terminated, the operation returns to step S403 for repeating the previously-described processing.

If the recording for one page is terminated at step S409, the operation proceeds to step S411, the recording sheet 11 is conveyed to a cutting position by a cutter 15, and cut in units of pages. And at step S412, the recording sheet 11 is rewound by a predetermined amount to align a leading end of the recording sheet at the recording position, and the recording process is terminated.

Figure 30:
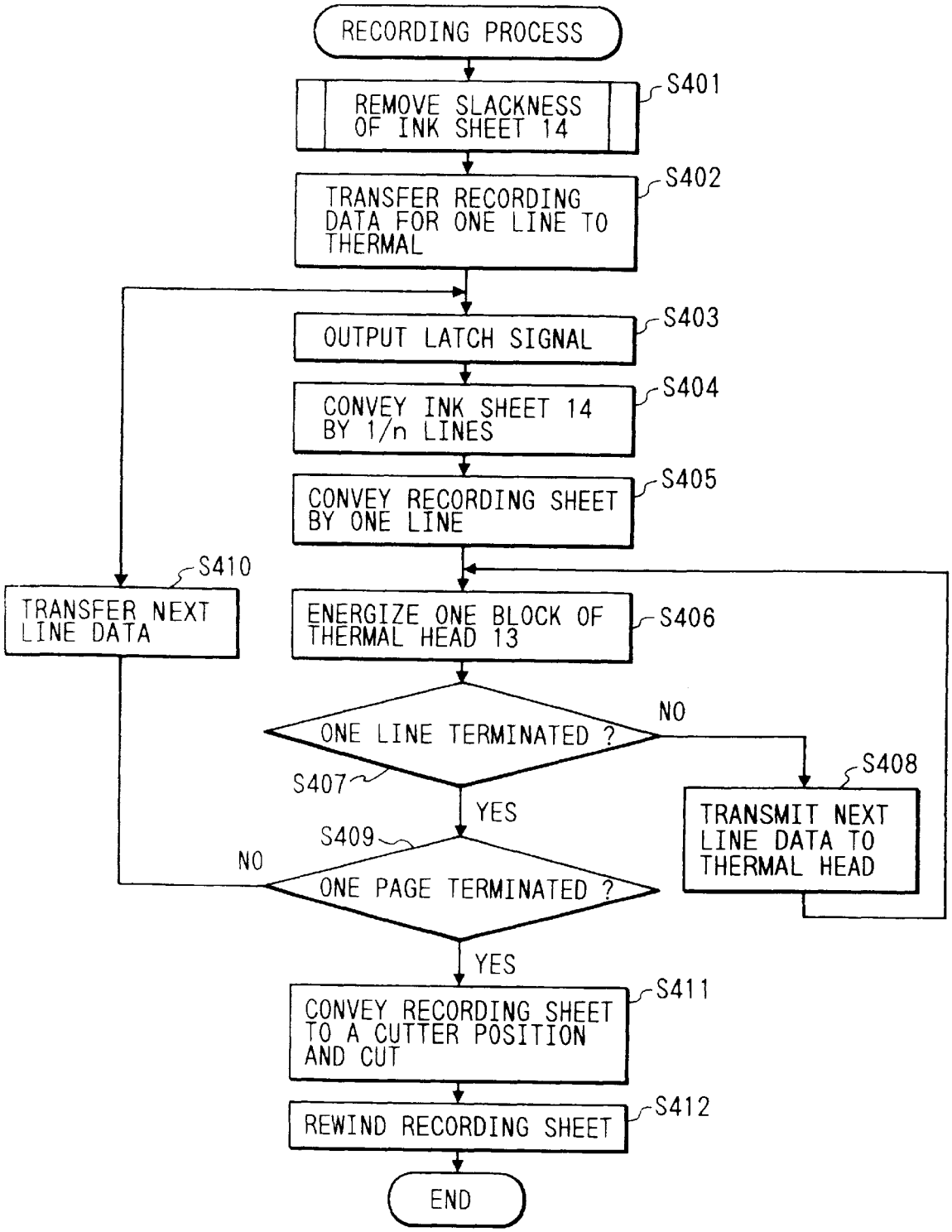
FIG. 30 is a flowchart showing a recording process in the facsimile terminal equipment of the example 3.
Figure 31:
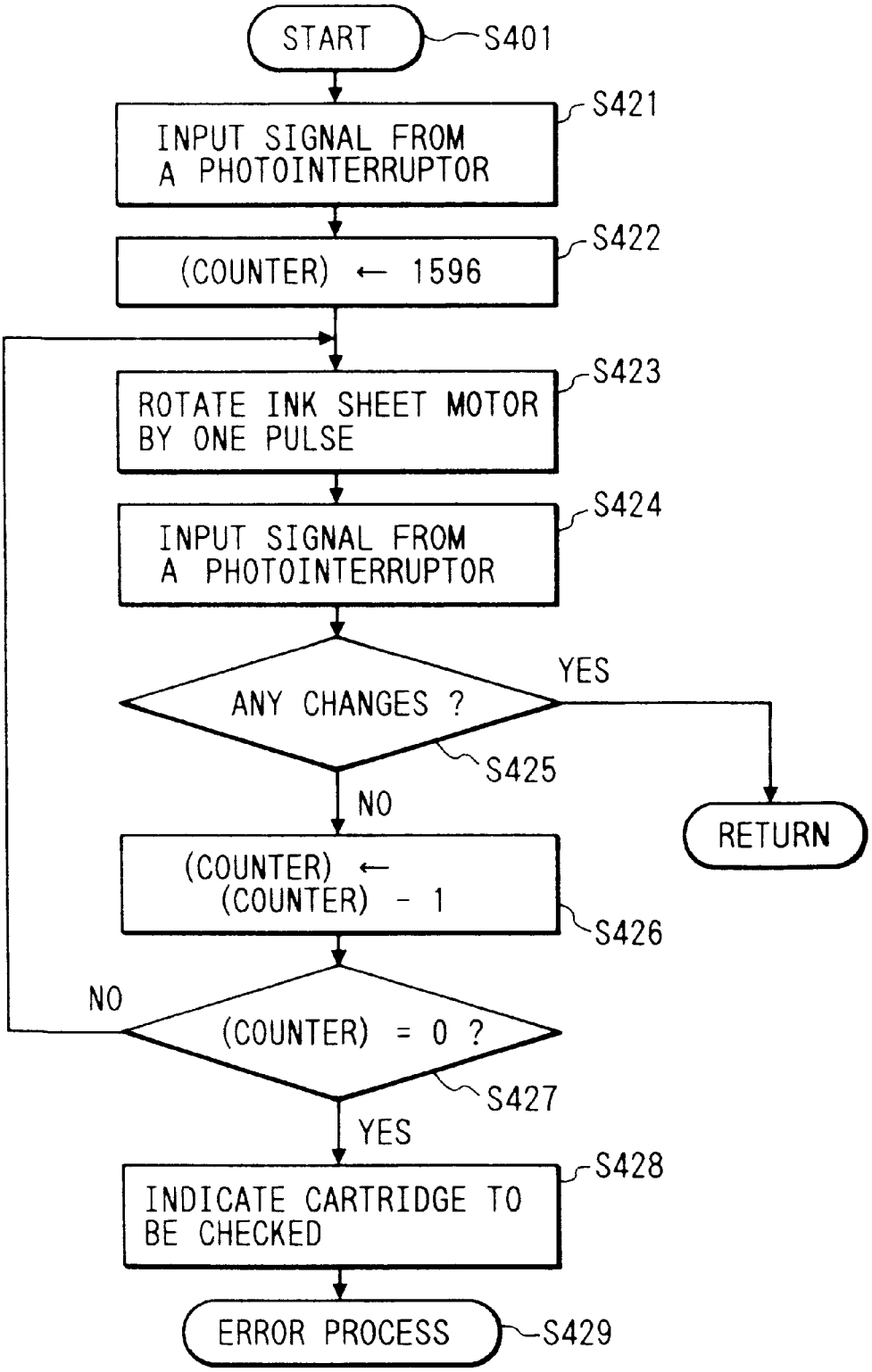
FIG. 31 is a flowchart showing an ink sheet slack removing process in the facsimile terminal equipment of the example 3.

FIG. 31 is a flowchart showing a process of removing the slackness of ink sheet 14, as shown at step S401 in FIG. 30.

At step S421, a signal from the photo interrupter 66 is input via the signal line 64, its state being stored. At step S422, "1596" is set to a counter of the RAM 115, and at step S423, the ink sheet conveying motor 25 is rotated by one pulse. Then proceeding to step S424, a signal from the photo interrupter 66 is input, and at step S425, a determination is made whether or not there is any change from the state of the signal from the photo interrupter 66 input at step S421. If there is a change, the operation returns to the original routine, by determining that the ink sheet 14 has been taken up and the ink sheet supply roller 17 has been rotated, so that there is no slackness in the ink sheet.

If the value of the counter is "0" at step S427, the ink sheet supply roller 17 has not been rotated even by driving the ink sheet conveying motor 25 by 1596 pulses, in which a message of checking the cartridge is displayed as the ink sheet 14 may be disconnected. And proceeding to step S429, an error process is carried out, in which the operation is halted to wait for the ink sheet cartridge to be exchanged.

Figure 32A:
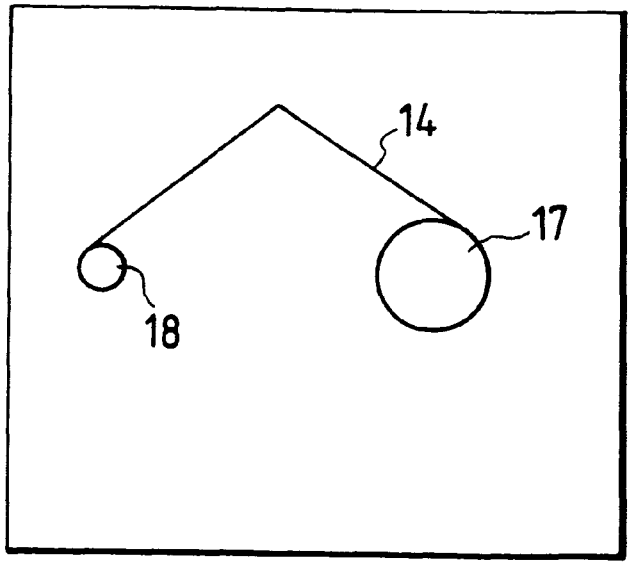
FIG. 32A to 32C are side views showing the take-up states of the ink sheet in the facsimile terminal equipment of the example 3.
Figure 32B:
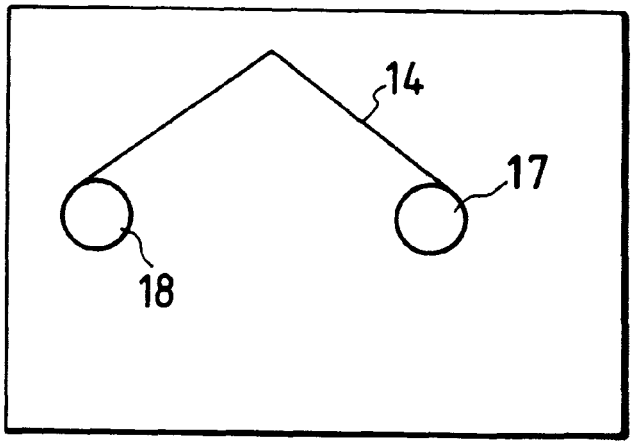

The meaning of the setting "1596" of the counter as previously described will be described with reference to FIG. 32. As the ink sheet is used, the diameters of the ink sheet take-up roll 18 and the ink sheet supply roll 17 change in order of FIG. 32A, FIG. 32B and FIG. 32C. When the diameter of the ink sheet take-up roll 18 is about 22 ϕ (22 mm) and the diameter of the ink sheet supply roll 17 is about 44 ϕ (44 mm) at the beginning of using the ink sheet 14, as shown in FIG. 32A, the ink sheet 14 is determined to be disconnected if the signal from the photo interruptor 66 may not change by taking up the ink sheet 14 about 5 cm. If so, a message of "check ink sheet" is displayed on the indication unit 104.

In FIG. 32A, if the number of half steps for conveying the ink sheet 14 by 5 cm is obtained, the conveyance distance in conveying the ink sheet 14 by one half step is $$\gamma\cdot 2\pi(\theta/360)(½)(1/i)$$

$$=(22/2)2\pi(1.8/360)(½)(1/44.13)$$

$$=3.915\times 10^{-3}(\text{mm})$$

Where the rotation angle of the ink sheet conveying motor 25 is 1.8 degrees.

$$(5\times 10/3.915\times 10^{-3})=12771 \text{ (half steps)}$$

As the conveying trigger of the ink sheet conveying motor 25 is 8 half steps, (12771/8)=1596 (triggers)

Figure 32C:
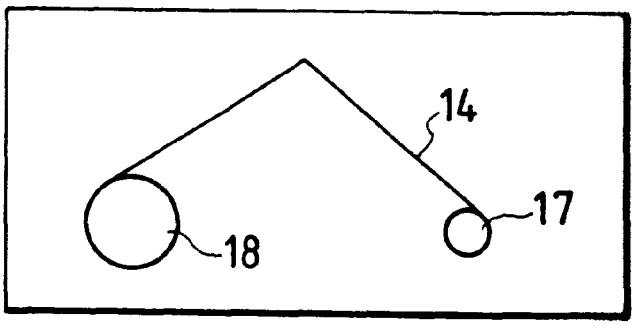

Therefore, the take-up diameter of the ink sheet take-up roller 18 is doubled in FIG. 32C, so that when the signal from the photo interrupter 66 may not change by taking up the ink sheet 14 by 10 cm, the ink sheet 14 is determined to be disconnected. FIG. 32B shows the state in which the take-up diameter of the ink sheet take-up roller 18 and the diameter of the ink sheet supply roll 17 are substantially the same.

On the other hand, if the signal from the photo interrupter 66 may change by the time when the ink sheet 14 is conveyed by 1596 triggers (12768 half steps), the operation proceeds to the recording operation by determining that the slackness removal of ink sheet has been terminated.

In the previous example, the slackness removal of ink sheet was practiced prior to recording of one page. However, the slackness of ink sheet may be removed prior to recording of one line. Specifically, it can be realized by executing step S401 after step S410 in FIG. 30.

As above described, according to this example, in the thermal transfer recording in which the length of the ink sheet 14 to be used in recording is L/N (n>1) for a predetermined recording length L, the slackness of ink sheet can be removed prior to recording, so that the recording can be properly made without adhesion between the ink sheet and the recording sheet.

Also, when the state of the signal from the photo interrupter 66 may not change by taking up the ink sheet by a predetermined amount, the ink sheet 14 is determined to be disconnected, and a notice is indicated on the indication unit 104, so that the operator can rapidly know the disconnection of the ink sheet if it may occur.

As above described, according to the present invention, it is possible to eliminate the occurrence of incorrect recording, or a broken ink sheet or dirty recording sheet due to the adhesion between the ink sheet and the recording sheet, by removing the slackness of ink sheet prior to recording.

[Explanation of Recording Principal (FIG. 33)]

Figure 33:
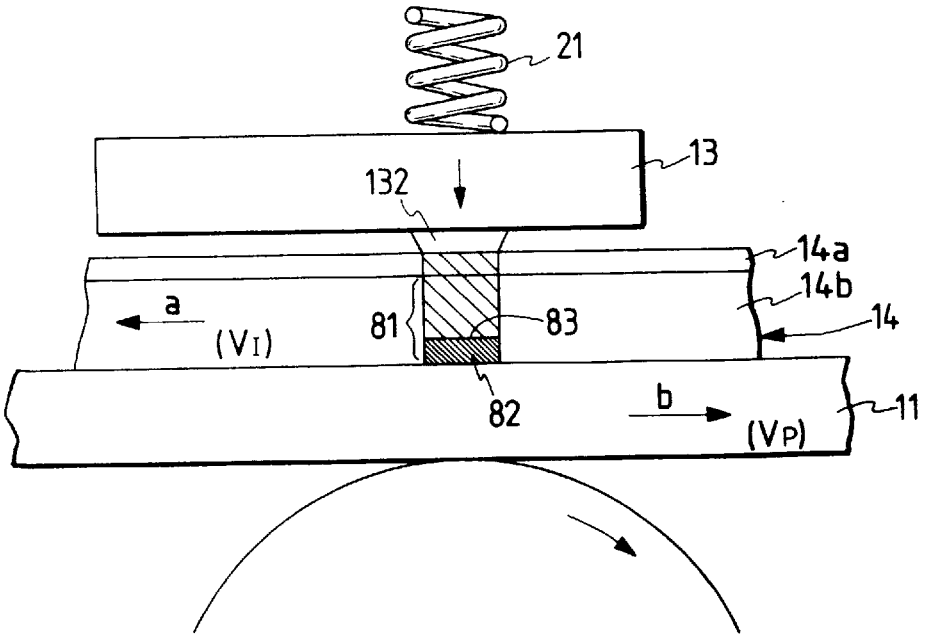
FIG. 33 is a view showing the state of the recording sheet and the ink sheet in recording in the examples 1 to 3.

FIG. 33 is a view showing the state in which an image is recorded in this example with the directions for conveying the recording sheet 11 and the ink sheet 14 being opposite.

As shown in the figure, the recording sheet 11 and the ink sheet 14 are carried between the platen roller 12 and the thermal head 13, with the thermal head 13 being pressed against the platen roller 12 at a predetermined pressure by means of a spring 21. Here the recording sheet 11 is conveyed in the arrow b direction at the speed $V_p$ with the rotation of the platen roller 12. On the other hand, the ink sheet 14 is conveyed in the arrow a direction at the speed $V_I$ with the rotation of the ink sheet conveying motor 25.

Now, if the heating resistive elements 132 of the thermal head 13 are energized and heated by the power source 105, a slanting line portion 81 of the ink sheet 14 is heated. 14*a* is a base film of the ink sheet 14, and 14*b* is an ink layer of the ink sheet 14. The ink in the ink layer 81 heated by energizing the heating resistive elements 132 becomes fused, with a part thereof as indicated at 82 being transferred to the recording sheet 11. The ink layer portion 82 to be transferred corresponds to almost 1/n of the ink layer as indicated at 81.

At such an ink transfer operation, it is necessary to transfer only the ink layer portion as indicated at 82 to the recording sheet 11 by yielding a shear force within the ink at a boundary line 83 with the ink layer 14*b*. And the ink layer to be transferred can be surely peeled off from the ink sheet 14 by increasing a relative speed between the ink sheet 14 and the recording sheet 11.

[Explanation of Ink Sheet (FIG. 34)]

Figure 34:
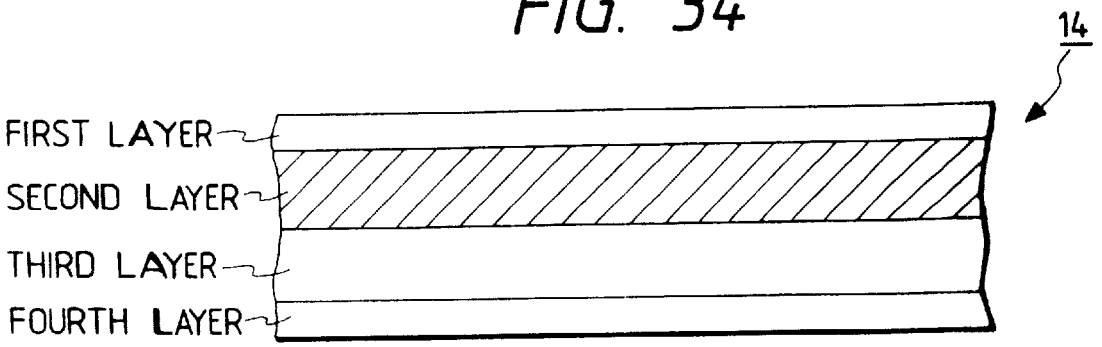
FIG. 34 is a cross-sectional view of a multi-print ink sheet useful in the examples 1 to 3.

FIG. 34 shows a cross-sectional view of an ink sheet for use in the multi print in this example, consisting of four layers.

The second layer is a base film serving as a carrier for the ink sheet 14. In the multi print, as the heat energy is applied to the same place as many times, it is advantageous to use a highly heat resistant aromatic polyamide film or condenser paper, but a conventional polyester film can be used as well. The thickness should be thinner from the viewpoint of the print quality, as the role of medium, but it is preferably in a range of 3–8 $\mu$m from the standpoint of strength.

The third layer is an ink layer containing a sufficient amount of ink to allow n times of transfers onto the recording sheet. This component has blended as the main components a resin such as EVA for adhesive, a carbon black or nigrosine dye for coloring, and a carnauba wax or paraffin wax for binding material, so as to withstand n multiple uses at the same location. The amount of application is preferably 4–8 g/m$^2$, but may be selected as desired, as the sensitiveness and density depend on the amount of application.

The fourth layer is a portion not to be used for the recording, i.e., a top coating layer for preventing the ink on the third layer from transferring with the pressure onto the recording sheet, made up of a transparent wax. Thereby, it is only the transparent fourth layer that is transferred with the pressure, as that it is possible to prevent the surface of recording sheet from being dirty. The first layer is a heat resistant coated layer for protecting the base film of the second layer from the heating of the thermal head 13. This is suitable for the multi print which has a possibility that the amount of heat energy corresponding to as many as n lines may be applied to the same place (for successive black data), but may or may not be used as appropriate. It is effective for the base film having a relatively low heat resistance such as a polyester film.

It should be noted that the constitution of the ink sheet 14 is not limited to one of the above example, but may be composed of a base layer and a porous ink holding layer containing the ink provided on one side of the base layer, or a heat resistive ink layer having a fine porous mesh structure on the base film and containing the ink within the ink layer. The material of the base film may be a film or paper composed of polyamide, polyethylene, polyester, polyvinylchloride, triacetylcellulose, nylon. Further, the heat resistive coating layer, which is not necessarily required, is made of the material such as silicon resin, epoxy resin, fluororesin, or nitrocellulose.

The heating method in the thermal transfer printer is not limited to a thermal head method using the thermal head as previously described, but may be a current or laser transfer method.

Also, the above example was explained in connection with an example using the thermal line head, but is not limited to such a line head, and may be a so-called serial-type for the thermal transfer printer. This example was described in connection with the multi print, but is not limited to this multi print, and it will be appreciated that this example is applicable to an ordinary thermal transfer recording with the one-time ink sheet.

Further, the above example was described with an instance in which the thermal transfer printer was applied to the facsimile terminal equipment, but is not limited to such an instance, and a thermal transfer recording apparatus of the present invention is also applicable to a word processor, a typewriter or a copying machine.

The recording medium is not limited to recording sheet, but may be a cloth or plastic sheet if the material is one onto which the ink can be transferred. Also, the ink sheet is not limited to a roll constitution as shown in the example, but may be an so-called ink sheet cassette type in which an ink sheet is contained within an enclosure which is detachably loaded into a main body of the recording apparatus.

While in the above example, the recording sheet is a roll sheet which is cut with a cutter, a cut sheet may be also used.

Also, the sensor for detecting the slackness of ink sheet, the conveyance speed of ink sheet and the number of conveying steps are not limited to those of this example, but can be appropriately changed.

What is claimed is:

1. A recording apparatus for recording an image by transferring ink contained in an ink sheet onto a recording medium, the apparatus comprising:

ink sheet conveying means for conveying said ink sheet, said ink sheet conveying means having a take-up roller and a supply roller, wherein said ink sheet extends between said take-up roller and said supply roller for conveyance by rotation of said take-up roller;

conveyance detecting means for detecting a rotation amount of said supply roller to detect that said ink sheet has been conveyed by said ink sheet conveying means;

opening/closing detecting means for detecting opening or closing of a cover for the apparatus; and slackness control means for removing a slackness of said ink sheet by rotating said take-up roller in a predetermined amount when said opening/closing detecting means detects that said cover is moved from an open state to a closed state, the predetermined amount for rotating the take-up roller being an amount of which rotation of said supply roller is detected by said conveyance detecting means even in a case where a diameter of said take-up roller is at a minimum because of an amount of said ink sheet thereon, wherein said slackness control means determines that the slackness of said ink sheet has been removed when said conveyance detecting means detects rotation of said supply roller and rotation of said take-up roller is stopped when said slackens control means determines that the slackness of said ink sheet has been eliminated, and wherein said slackness control means provides a warning when rotation of said supply roller is not detected by said conveyance detecting means during conveyance of a predetermined amount.

2. A recording apparatus according to claim 1, further comprising reading means for reading an original.

3. A recording apparatus according to claim 1, further comprising transmitting means for transmitting recording image data through a signal line.

4. The recording apparatus according to claim 1, further comprising recording means for recording onto said recording medium by acting on said ink sheet in accordance with an image signal.

5. The recording apparatus according to claim 1, further comprising conveyance control means for maintaining a conveyance amount of said ink sheet and a conveyance amount of said recording medium constant, based on the rotation amount of the supply roller detected by said conveyance detecting means.

6. The recording apparatus according to claim 1, further comprising recording medium conveying means for conveying said recording medium.

7. The recording apparatus according to claim 6, wherein a conveyance amount of said ink sheet per unit time with said ink sheet conveying means is less than a conveyance amount of said recording medium per unit time with said recording medium conveying means.

8. An image forming apparatus for recording an image by transferring ink contained in an ink sheet onto a recording medium, the ink sheet being supplied from a supply roller, the apparatus comprising:

ink sheet conveying means for conveying said ink sheet by rotating a take-up roller;

conveyance detecting means for detecting a rotation amount of the supply roller to detect that said ink sheet has been conveyed by said ink sheet conveying means;

opening/closing detecting means for detecting opening or closing of a cover for the apparatus; and slackness control means for removing slackness of said ink sheet when said opening/closing detecting means detects that said cover is moved from an open state to a closed state, wherein said slackness control means determines that the slackness of said ink sheet has been removed when said conveyance detecting means detects rotation of said supply roller during that said ink sheet conveying means is driven and said ink sheet is conveyed by a predetermined amount, the predetermined amount being an amount of which rotation of said supply roller is detected by said conveyance detecting means even in a case where a diameter of said take-up roller is at a minimum because of an amount of the ink sheet thereon, and rotation of said take-up roller is stopped when said slackens control means determines that the slackness of said ink sheet has been eliminated, and wherein said slackness control means provides a warning when rotation of said supply roller is not detected by said conveyance detecting means during conveyance of a predetermined amount.

9. The image forming apparatus according to claim 8, further comprising recording medium conveying means for conveying said recording medium.

10. The image forming apparatus according to claim 8, further comprising:

image signal receiving means; and recording means for recording onto said recording medium by acting on said ink sheet, based on an image signal received by said image signal receiving means.

11. The image forming apparatus according to claim 8, further comprising conveyance control means for maintaining a conveyance amount of said ink sheet and a conveyance amount of said recording medium constant, based on the rotation amount of the supply roller detected by said conveyance detecting means.

12. A recording method for recording an image by using an apparatus that transfers ink contained in an ink sheet onto a recording medium, said ink sheet extending between a take-up roller and a supply roller, the method comprising the steps of:

detecting opening or closing of a cover for the apparatus;

removing a slackness of said ink sheet by rotating said take-up roller and by conveying the ink sheet in a predetermined amount when said cover is moved from an open state to a closed state, the predetermined amount being an amount of which rotation of said supply roller is detected in said detecting step even in a case where a diameter of said take-up roller is at a minimum because of an amount of the ink sheet thereon;

detecting rotation of the supply roller to detect conveyance of said ink sheet;

determining that the slackness of said ink sheet has been removed in a case where the rotation of said supply roller is detected in said detecting opening step during which said ink sheet is conveyed by said detecting step even in the case where a diameter of said take-up roller is at a minimum because of the amount of the ink sheet thereon; and providing a warning when rotation of said supply roller is not detected in said detecting step during conveyance of a predetermined amount.

* * * * *

UNITED STATES PATENT AND TRADEMARK OFFICE

CERTIFICATE OF CORRECTION

PATENT NO. : 6,169,560 B1
DATED : January 2, 2001
INVENTOR(S) : Takehiro Yoshida et al.

It is certified that error appears in the above-identified patent and that said Letters Patent is hereby corrected as shown below:

Title page, Item [56],
References Cited, U.S. PATENT DOCUMENTS, "Dartouzos et al." should read -- Dertouzos et al. --

Column 1,
Line 39, "or" should be deleted; and
Line 60, "not constant" should read -- a --.

Column 2,
Line 6, "of" should be deleted;
Line 12, "slackness of" should read -- slack from --; and
Line 14, "made" should be deleted.

Column 3,
Line 63, "ink" should read -- ¶ink --.

Figure 6B:
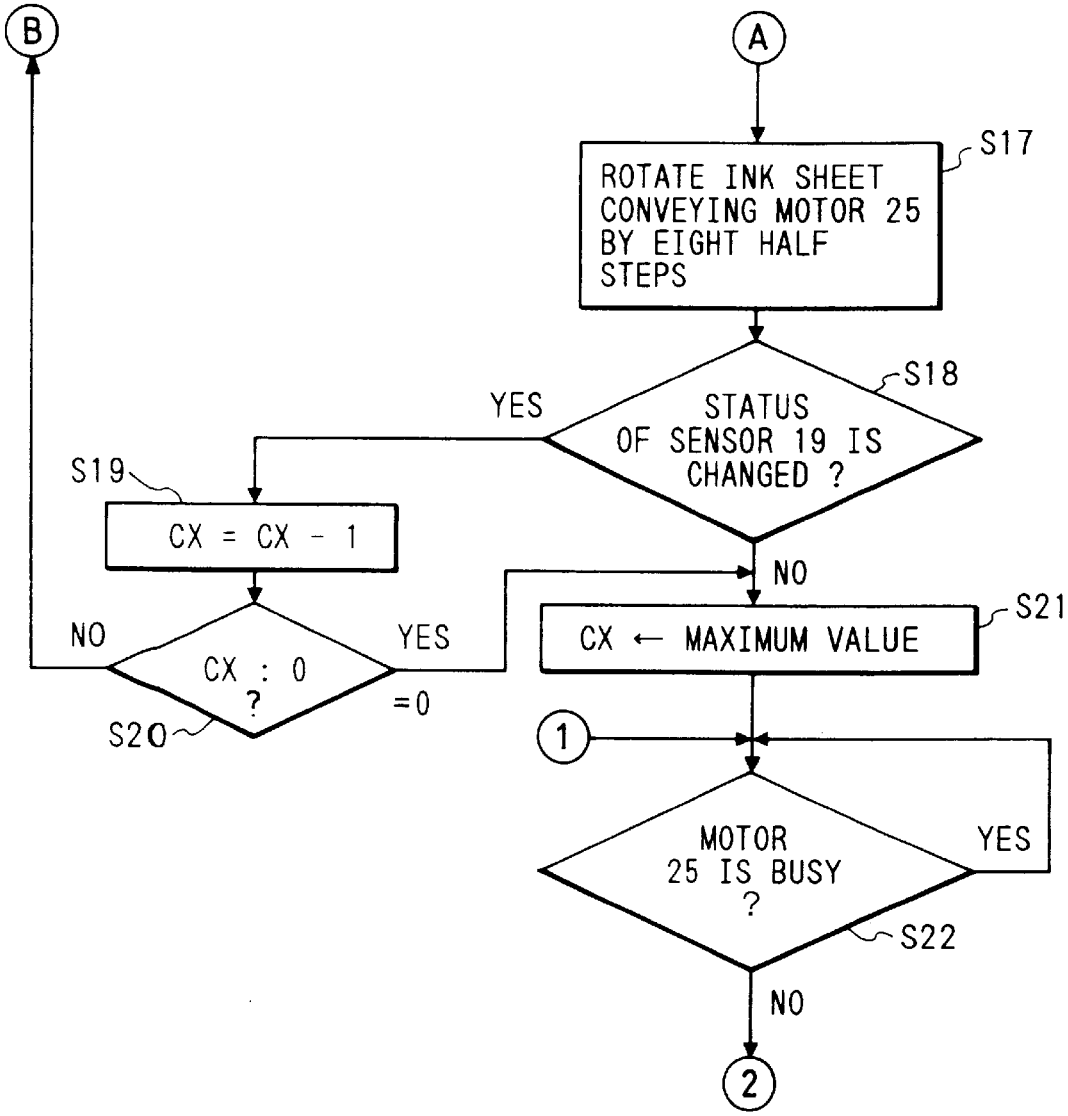
Figure 21B:
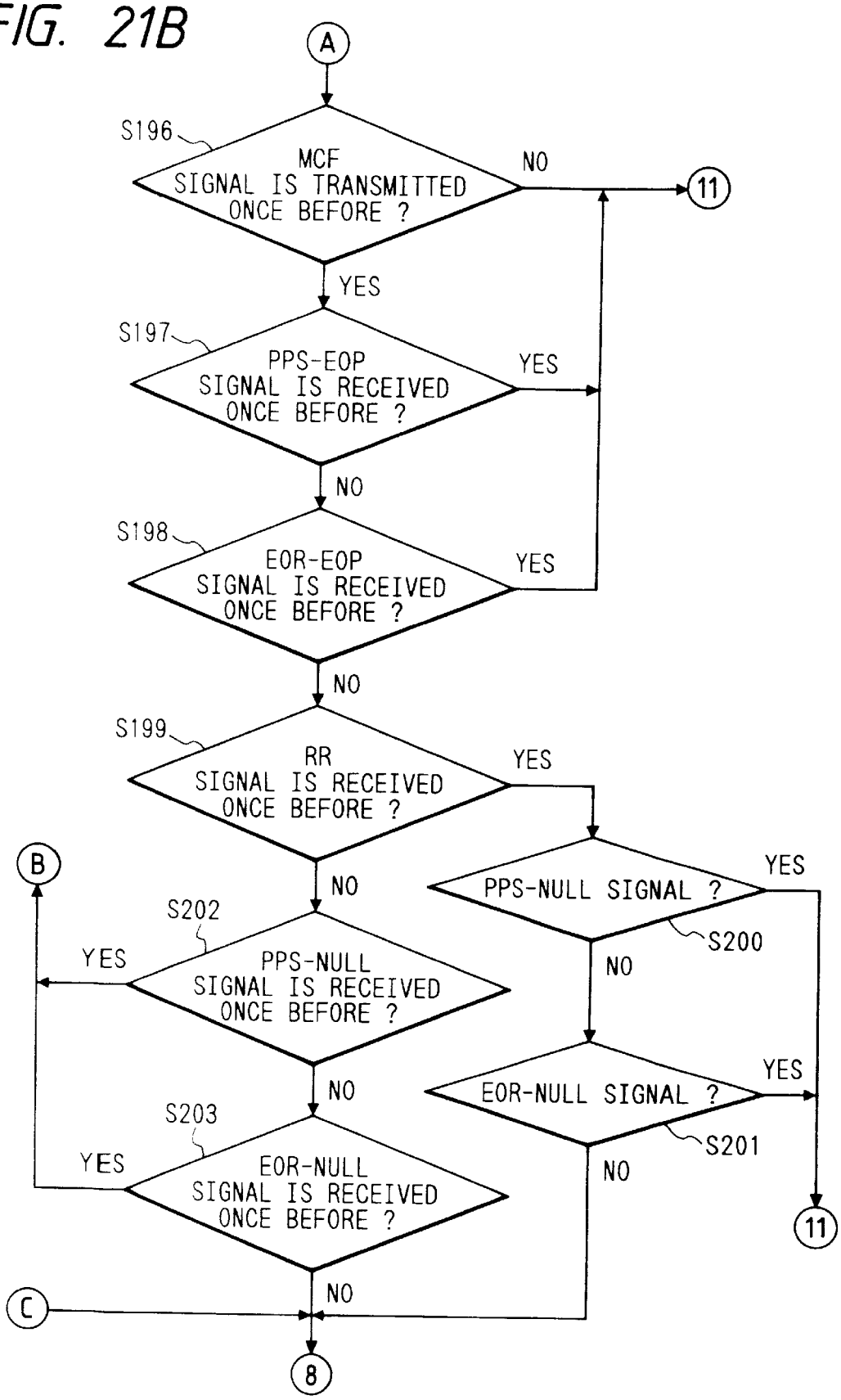

Column 4,
Line 28, "FIGS. 6, 6A, 6B" should read -- FIGS. 6A, 6B --; and
Line 41, "FIGS. 21, 21A, 21B" should read -- FIGS. 21A, 21B --.

Column 6,
Line 13, "rolled" should read -- rollers --;
Line 18, "thereon" should read -- thereon, --; and
Line 50, "41 is" should read -- ¶41 is --.

Column 7,
Line 15, "there-through" should read -- therethrough --;
Line 28, "for" should read -- to cause --;
Line 29, "to cause" should read -- for --; and
Line 34, "alter" should be deleted.

Column 8,
Lines 21, and 24, "(thereinafter" should read -- (hereinafter --; and
Line 27, "unit 101" should read -- unit 101 during --.

Column 14,
Line 13, "slackness" should read -- slack --.

Column 17,
Line 12, "2will" should read -- 2 will --.

UNITED STATES PATENT AND TRADEMARK OFFICE

CERTIFICATE OF CORRECTION

PATENT NO. : 6,169,560 B1
DATED : January 2, 2001
INVENTOR(S) : Takehiro Yoshida et al.

It is certified that error appears in the above-identified patent and that said Letters Patent is hereby corrected as shown below:

Column 25,
Line 45, "slackens" should read -- slackness --.

Column 26,
Line 29, "during that" should read -- when --; and
Line 37, "slackens" should read -- slackness --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*